US008245469B2

(12) United States Patent
Rubel et al.

(10) Patent No.: US 8,245,469 B2
(45) Date of Patent: Aug. 21, 2012

(54) DECK ASSEMBLY MODULE FOR A STEEL FRAMED BUILDING

(75) Inventors: Zigmund Rubel, Greenbrae, CA (US); Mabe Ng, San Francisco, CA (US)

(73) Assignee: Aditazz, Inc., East Palo Alto, CA (US)

( * ) Notice: Subject to any disclaimer, the term of this patent is extended or adjusted under 35 U.S.C. 154(b) by 0 days.

(21) Appl. No.: 13/112,980

(22) Filed: May 20, 2011

(65) Prior Publication Data

US 2011/0283643 A1 Nov. 24, 2011

Related U.S. Application Data

(60) Provisional application No. 61/346,812, filed on May 20, 2010.

(51) Int. Cl.
*E04C 1/00* (2006.01)

(52) U.S. Cl. ..... 52/309.12; 52/309.17; 52/309.16; 52/223.6; 52/404.1; 52/707

(58) Field of Classification Search ..... 52/309.12, 52/309.15–309.17, 327, 405.1, 404.1, 298, 52/704, 707, 653.1, 650.3, 582.1, 223.6, 52/602, 223.1, 408
See application file for complete search history.

(56) References Cited

U.S. PATENT DOCUMENTS

| | | | | |
|---|---|---|---|---|
| 3,029,561 A | | 4/1962 | Clay | |
| 4,037,375 A | | 7/1977 | Maggos et al. | |
| 4,120,131 A | | 10/1978 | Carroll | |
| 4,144,369 A | | 3/1979 | Wass | |
| 4,285,173 A | * | 8/1981 | Grearson et al. | 52/73 |
| 4,300,320 A | * | 11/1981 | Rooney | 14/73 |
| 4,800,697 A | | 1/1989 | Oswald | |
| 5,113,625 A | * | 5/1992 | Davis | 52/143 |
| 5,396,747 A | | 3/1995 | Breuning | |
| 5,399,050 A | | 3/1995 | Jacobus | |
| 5,425,214 A | | 6/1995 | Truelove et al. | |
| 5,758,467 A | | 6/1998 | Snear et al. | |
| 5,953,864 A | | 9/1999 | Beck | |

(Continued)

FOREIGN PATENT DOCUMENTS

WO 9733788 A1 9/1997

OTHER PUBLICATIONS

International Search Report and Written Opinion mailed on Sep. 8, 2011, for PCT patent application No. PCT/US2011/037452 filed May 20, 2011, 11 pages.

*Primary Examiner* — Brian Glessner
*Assistant Examiner* — Brian D Mattei

(57) ABSTRACT

A deck assembly module is disclosed. The deck assembly module can be installed into the steel frame of a steel framed building. The deck assembly module includes a cellular metal deck. In an embodiment, the cellular metal deck includes a bottom plate having a top major surface and a bottom major surface, an angled decking sheet, and fireproof insulation. The angled decking sheet is angled to form a repeating pattern of troughs and peaks, the angled decking is adjacent to the top major surface of the bottom plate, and the fireproof insulation is located in channels formed by the peaks of the angled decking sheet and the top surface of the bottom plate and the angled decking sheet. The deck assembly module may also include a concrete portion that includes a top major surface, referred to as a concrete deck.

35 Claims, 29 Drawing Sheets

U.S. PATENT DOCUMENTS

| | | | | |
|---|---|---|---|---|
| 6,467,223 | B1 | 10/2002 | Christley | |
| 6,484,471 | B2 * | 11/2002 | Steed et al. | 52/704 |
| 6,568,139 | B2 * | 5/2003 | Bot | 52/250 |
| 6,804,923 | B1 | 10/2004 | Potter | |
| 2006/0179750 | A1 * | 8/2006 | Patrick | 52/309.16 |
| 2007/0000077 | A1 * | 1/2007 | Wilson | 14/73 |
| 2007/0101675 | A1 * | 5/2007 | Veerman et al. | 52/741.1 |
| 2008/0010943 | A1 * | 1/2008 | Marschke | 52/793.1 |
| 2008/0295433 | A1 | 12/2008 | Eyal et al. | |
| 2009/0057486 | A1 | 3/2009 | Becht, IV et al. | |
| 2009/0188193 | A1 * | 7/2009 | Studebaker et al. | 52/321 |
| 2009/0266010 | A1 | 10/2009 | Lomske et al. | |
| 2009/0272067 | A1 * | 11/2009 | Gilham | 52/707 |

* cited by examiner

DECK ASSEMBLY MODULE FOR A STEEL FRAMED BUILDING

CROSS-REFERENCE TO RELATED APPLICATION

This application is entitled to the benefit of provisional U.S. patent application Ser. No. 61/346,812, filed May 20, 2010, which is incorporated by reference herein.

FIELD OF THE INVENTION

The invention relates generally to steel framed buildings, and, more specifically to modular components for steel framed buildings.

BACKGROUND

Steel framed buildings include a steel frame of columns, girders, and beams that support concrete decks. Once installed, the concrete decks form the base of the various floors of the building. Building systems such as walls, facilities components (e.g., electrical, plumbing, and heating, ventilation, and air conditioning (HVAC) components), and equipment are then attached to the concrete deck to finish out the building. In the construction of steel framed buildings, the concrete decks are typically assembled onsite with individual components and without any aggregation of the individual components prior to arriving on the construction site. Variations in onsite assembly techniques, materials, and conditions can lead to inconsistencies in the quality of the finished concrete decks. For example, assembly of concrete decks typically includes mixing and pouring of concrete at the construction site. There are many variables, such as the weather, the quality of the concrete components, and the skill of the people doing the work, which affect the quality of the resulting concrete and which are difficult to control at a construction site.

In addition to the variables involved in onsite assembly of concrete decks for steel framed buildings, other issues related to concrete decks can affect the construction of a steel framed building. For example, the top portion of a full height wall in the interior of a steel framed building is referred to as the "head of wall condition." The head of wall condition exists at fire, smoke, and/or sound rated walls and because of variations in the design and construction of concrete decks, the head of wall condition needs to be evaluated individually in each steel framed building to ensure that applicable fire, smoke, and/or sound ratings are met. Additionally, the anchoring of building systems, such as interior walls, facilities components, and equipment to concrete decks is typically customized for each individual steel framed building. Further, the onsite customization of anchoring systems does not typically take into account any future needs and/or uses of the steel frame building.

SUMMARY

A deck assembly module is disclosed. The deck assembly module can be installed into the steel frame of a steel framed building. The deck assembly module includes a cellular metal deck. In an embodiment, the cellular metal deck includes a bottom plate having a top major surface and a bottom major surface, an angled decking sheet, and fireproof insulation. The angled decking sheet is angled to form a repeating pattern of troughs and peaks, the angled decking is adjacent to the top major surface of the bottom plate, and the fireproof insulation is located in channels formed by the peaks of the angled decking sheet and the top surface of the bottom plate and the angled decking sheet. The deck assembly module may also include a concrete portion that includes a top major surface, referred to as a concrete deck. The concrete for the concrete portion of the deck assembly module can be poured into the cellular metal deck in an offsite assembly facility or the concrete portion of the deck assembly module can be mixed and poured into the cellular metal deck at or near the construction site.

Other aspects and advantages of embodiments of the present invention will become apparent from the following detailed description, taken in conjunction with the accompanying drawings, illustrated by way of example of the principles of the invention.

BRIEF DESCRIPTION OF THE DRAWINGS

Throughout the description, similar reference numbers may be used to identify similar elements. Additionally, in some cases, reference numbers are not repeated in each figure in order to preserve the clarity and avoid cluttering of the figures.

DETAILED DESCRIPTION

Figure 1:
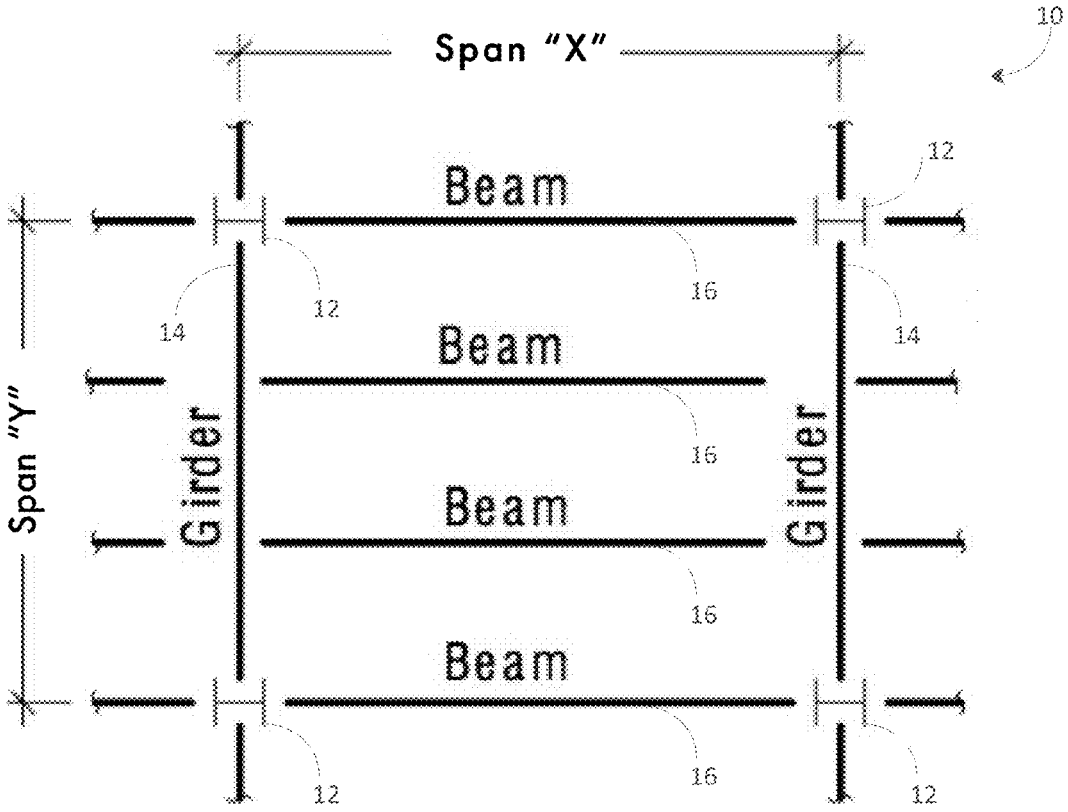
FIG. 1 depicts a plan view of a steel frame of a steel framed building.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment. Rather, language referring to the features and advantages is understood to mean that a specific feature, advantage, or characteristic described in connection with an embodiment is included in at least one embodiment. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment," "an embodiment," or similar language means that a particular feature, structure, or characteristic described in connection with the indicated embodiment is included in at least one embodiment. Thus, the phrases "in one embodiment," "in an embodiment," and similar language throughout this specification may, but do not necessarily, all refer to the same embodiment.

In an embodiment, a deck assembly module is disclosed. The deck assembly module can be installed into the steel frame of a steel framed building. The deck assembly module includes a cellular metal deck and may include a concrete portion that includes a top major surface, referred to as a concrete deck. The concrete for the concrete portion of the deck assembly module can be poured into the cellular metal deck in an offsite assembly facility or the concrete portion of the deck assembly module can be mixed and poured into the cellular metal deck at or near the construction site.

In either case, the deck assembly module can be assembled prior to being installed into the steel frame of a steel framed building. A deck assembly module as described in detail below can be fabricated to fit within the steel frame of a steel framed building, the deck assembly module can be designed to reduce the combined floor and beam system dimensions, the deck assembly module exhibits a reduced weight, and the deck assembly module may include attachment elements that provide for easy attachment of various building systems at an array of locations.

FIG. 1 depicts a plan view of a steel frame 10 of a steel framed building. The steel frame includes columns 12, which are generally vertical to the surface on which the building sits, and girders 14 and beams 16, which are generally horizontal to the surface on which the building sits. Steel frames and steel framed buildings are well known in the field.

In the embodiment of FIG. 1, the columns 12 are "I" shaped steel beams, referred to as "I-beams." In general, the I-beams are spaced apart in a grid structure that includes an X-span dimension and a Y-span dimension. For example, X and Y spans in the range of 10-70 feet are known and X and Y spans in the range of 20-40 are common. Additionally, other dimensions are possible. Although I-beams are described as one type of steel column, other types and/or shapes of steel columns are possible. Further, the columns may be made out of other materials and/or a composite of steel and at least one other material.

In the embodiment of FIG. 1, the girders 14 and beams 16 are "I" shaped steel beams, sometimes referred to as "W sections." Typically, the girders connect to the columns in one direction and the beams connect between the girders and the columns 12 in a direction that is perpendicular to the girders. Although the girders and beams have been described as I-beams, in alternative embodiments, the girders and beams may include, for example, rectangular tubes, tees, angled shaped pieces, and zee shaped pieces.

Figure 2A:
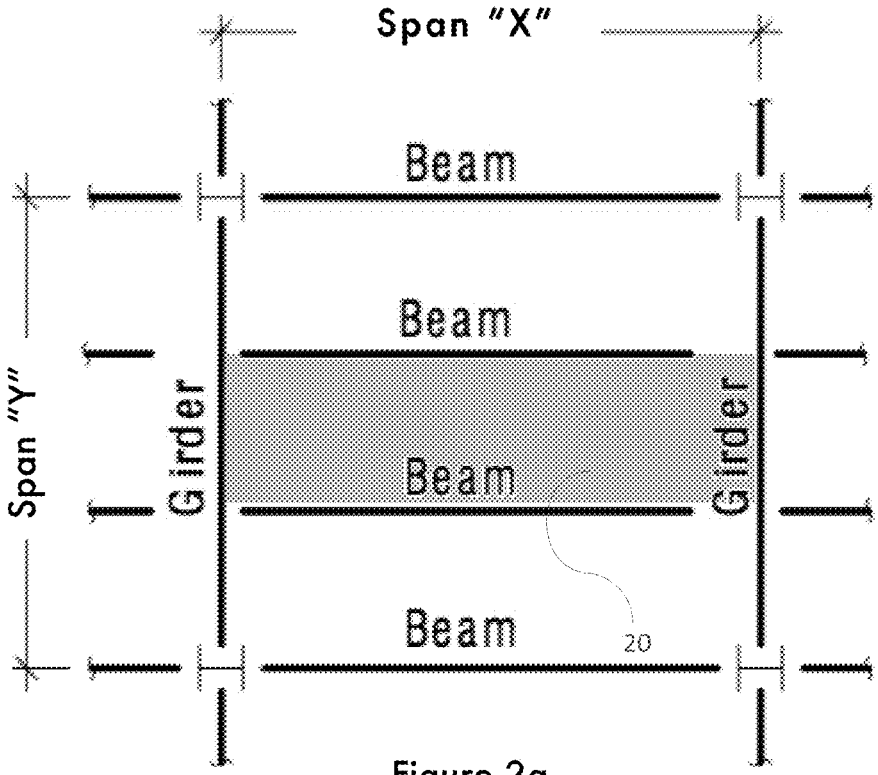
FIG. 2*a* highlights a mid-bay in the steel frame of FIG. 1.
Figure 2B:
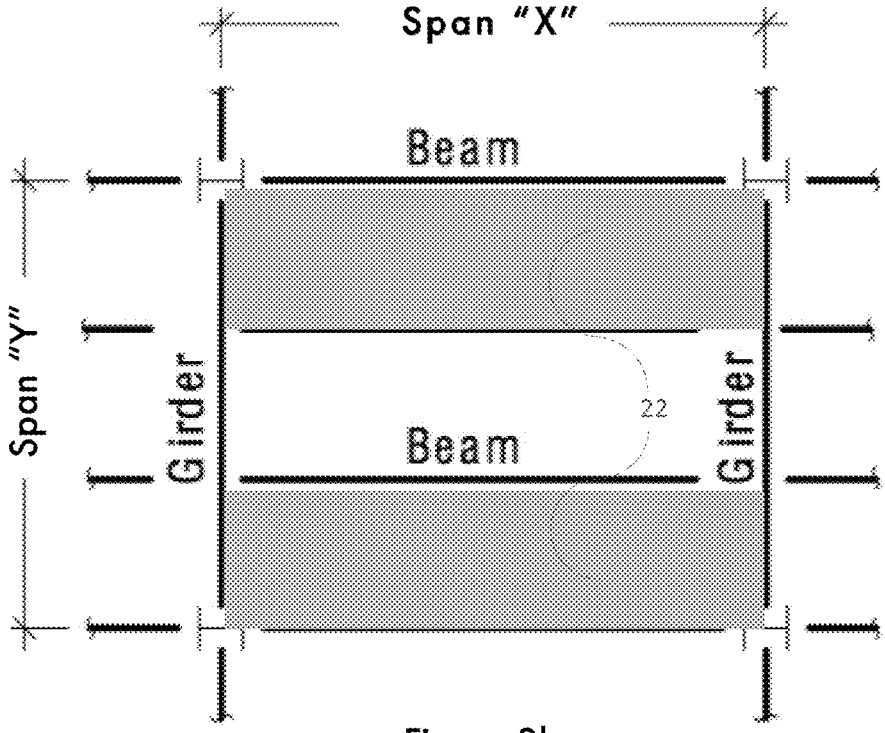
FIG. 2*b* highlights two end-bays in the steel frame of FIG. 1.

The spacing of the girders 14 is dictated by the spacing of the columns 12. The spacing of the beams 16 is more flexible. In an embodiment, beams are located between pairs of columns and additional beams are located between columns. In an embodiment, beams are spaced apart by about 10 feet, although other spacing is possible. As will be described below, the spacing of the columns, girders, and beams forms "bays," where a bay is generally defined as the area bordered by a pair of parallel girders and a pair of parallel beams. The dimensions of the bays may be the same from bay-to-bay or may vary depending on the building. In an embodiment, some of the bays in a building have similar dimensions while other bays of the building have dimensions that are customized to correspond to specific features of the building. As is described below, the deck assembly modules are sized such that a deck assembly module fills a bay. The shape of a bay may vary depending on whether the bay is a mid-bay or an end-bay, where a mid-bay is bordered by girders and beams but does not include any column connection points and an end-bay includes at least one column connection point. FIG. 2*a* highlights a mid-bay 20 in the steel frame 10 of FIG. 1. As shown in FIG. 2*a*, the mid-bay does not have any sides or corners that are formed by a column 12. FIG. 2*b* highlights two end-bays 22 in the steel frame 10 of FIG. 1. As shown in FIG. 2*b*, the two end-bays have two corners of the bays that are at least partially formed by a column. The existence of the columns at the corners of the bays changes the shape of the end-bays. For example, the end-bays are not rectangular like the mid-bays but have polygonal and/or curvilinear features, particularly at the corners that include the columns. In an embodiment, deck assembly modules that are intended for end-bays are configured to cope around the columns of the steel frame. Additionally, the shape of the deck assembly modules will depend on which side of the deck assembly module abuts to the columns. In some embodiments, a steel framed building may not include a column at four points of a bay as depicted in FIGS.

1-2*b*. For example, a steel framed building may not include a column at a perimeter location of the steel framed building or at a cantilevered floor. In these cases, it is possible to have a deck assembly module that has coping to accommodate only one column. Additionally, it is possible to have a deck assembly module that has coping to accommodate more than two columns or features other than columns.

In an embodiment, each deck assembly module is configured to have a shape that corresponds to the shape of the bays that are formed by the steel frame 10. For example, deck assembly modules intended for the mid-bays 20 are shaped to correspond to the shape of the mid-bays and deck assembly modules intended for the end-bays 22 are shaped to correspond to the shape of the end-bays. Additionally, deck assembly modules that are intended for end-bays are shaped to correspond to the particular location of the columns. For example, the two corners of a deck assembly module that will abut to a column are dependent on the location of the deck assembly module relative to the columns. With reference to FIG. 2*b*, the upper end-bay needs a deck assembly module that has coped corners at the upper right and upper left corners and the lower end-bay needs a deck assembly module that has coped corners at the lower right and lower left corners. The size and shape of the deck assembly module can be set to correspond to various different sizes and configurations of steel frames. For example, the deck assembly modules can be designed to accommodate any size and configuration of girders 14 and/or beams 16. In an embodiment, the deck assembly module is configured to cooperate with any of the structural configurations commonly used, such as circular or rectangular tubes, channels, angles and or tees.

In an embodiment, the exact size and shape of the deck assembly module is governed in part by at least one of the following parameters: structural performance requirements of the steel frame 10; the framing geometry of the steel frame; transportation requirements of the jurisdictions in which the deck assembly module is transported on public roads; and vehicle availability for transport. In an embodiment, the deck assembly module is designed with a 10'-0" maximum width dimension and a fifty foot maximum length dimension so that the deck assembly module can be transported as one piece on public roads using conventional transportation means. In another embodiment, the deck assembly module is designed with a 15'-0" maximum width dimension and a fifty foot maximum length dimension, although it should be understood that other dimensions are possible.

Embodiments of a deck assembly module are now described in detail with respect to FIGS. 3*a*-9*i*. The description is provided in a sequential order that corresponds to the order of assembly. Although the below-provided description corresponds to an example of a deck assembly module and an example of a sequential order of assembly, it should be understood that other embodiments of the deck assembly module and techniques and/or orders of assembly are possible.

In the embodiments of FIGS. 3*a*-9*i*, the deck assembly module is designed to be compatible with a standard 3" deck. For example, the embodiments of FIGS. 3*a*-9*i* are based on a 3" deck that is commonly used in commercial buildings requiring a 200-300 pound live to dead load combination, per square foot. In other embodiments, decks of other thicknesses are possible. For example, the deck assembly module may have a thickness in the range of 1½ inches-12 inches.

Figure 3A:
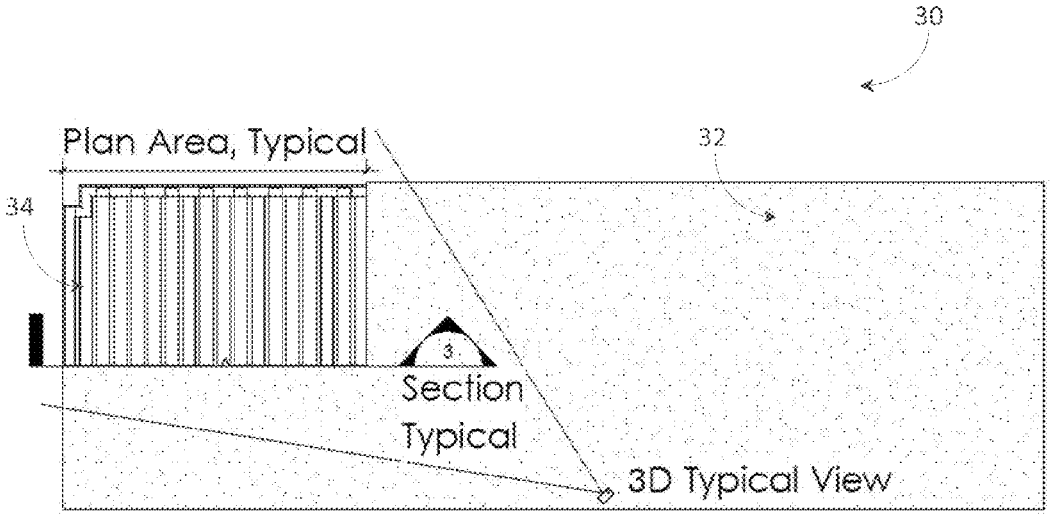
FIG. 3*a*-3*i* depict plan, side, and perspective views of various embodiments of a cellular metal deck.

In the embodiments of FIGS. 3*a*-9*i*, the deck assembly module includes a cellular metal deck and a concrete portion. FIG. 3*a* depicts a plan view of a deck assembly module 30 showing a concrete deck 32 with a cutaway portion 34 that illustrates an underlying cellular metal deck. In subsequent figures, views of the cutaway portion of the deck assembly module are shown in a plan view, a section view, and a perspective (three-dimensional) view. The cellular metal deck includes an angled decking sheet, sometimes referred to as a corregated metal sheet. In an embodiment, the angled decking sheet of a deck assembly module is 14 (thickest) to 26 (thinnest) gauge galvanized or stainless steel material. The angled metal sheet of a deck assembly module typically does not come in sizes large enough to cover an entire bay and therefore, multiple sheets of angled metal are attached together to form a single angled decking sheet that is big enough to cover an entire bay. The sheets can be attached together using known techniques such as welding, screwing, and fastening. FIG. 3*b* depicts a plan view of multiple angled decking sheets 36 that will be attached together, FIG. 3*c* depicts a side view of the angled decking sheets of FIG. 3*b*, and FIG. 3*d* depicts a perspective view of the angled metal sheets of FIGS. 3*b* and 3*c*. As shown in FIGS. 3*b*-3*d*, the angled metal sheets have angles that form a repeating pattern of troughs and peaks. With reference to FIG. 3*c*, a trough is identified by reference number 38 and a peak is identified by reference number 40 and the repeating pattern of troughs and peaks form parallel channels, for example, channel 42 on the top side of the angled metal sheet and channel 44 on the bottom side of the angled metal sheet, see FIG. 3*d*. Although a particular configuration of angles is depicted herein, other configurations of the angles of the angled metal sheet are possible. Additionally, the angled metal sheet have rounded portions instead of or in addition to the linear portions depicted and described herein.

Figure 3B:
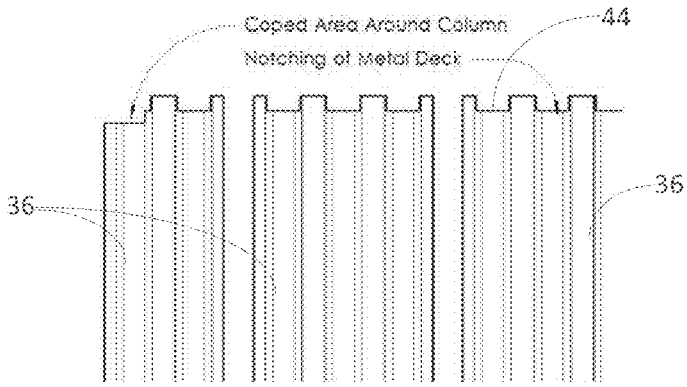
Figure 3C:
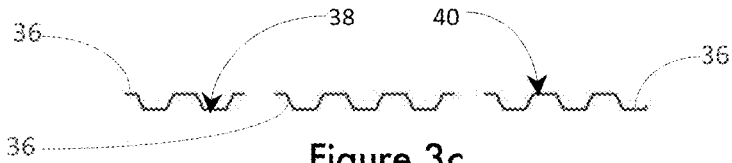
Figure 3D:
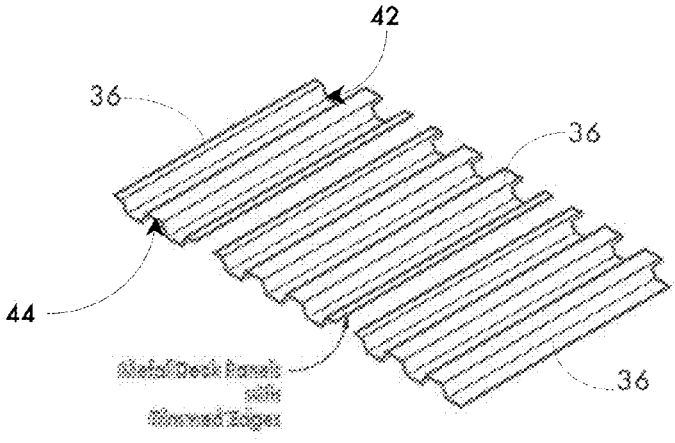

With reference to FIG. 3*b*, the upper left corner of the leftmost sheet has a corner that is shaped or coped to fit around a column. Additionally, the angled metal sheets 36 include notches 44 on opposing sides of the angled metal sheets. In an embodiment, the angled metal sheets include notches at the outer perimeter as depicted in FIGS. 3*b* and 3*d*. In an embodiment, the notches allow the deck assembly module to sit partially below the top flange of the beams and girders of the steel frame 10 as is described below with reference to FIG. 11*c*.

In an embodiment, the angled decking sheet 36 is attached to a bottom plate, which is a metal plate that has a top major surface and a bottom major surface. The angled decking sheet is attached to the bottom plate such that metal channels or tubes are formed in the areas of the troughs. Fireproof insulation is located within the metal channels to produce a fire rated deck assembly.

Figure 3E:
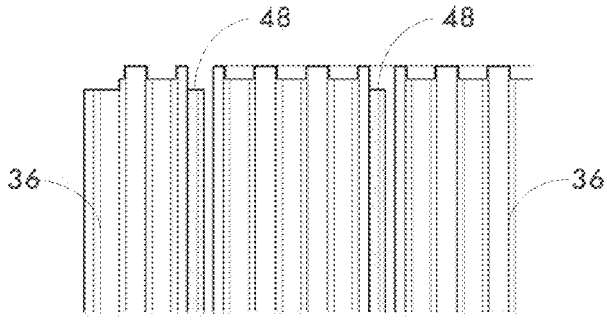
Figure 3F:
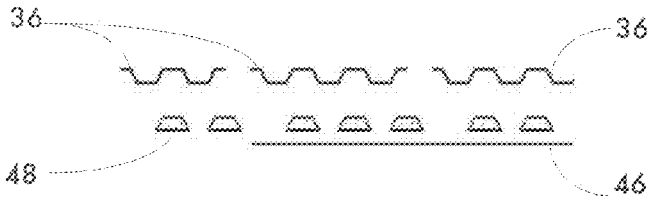
Figure 3G:
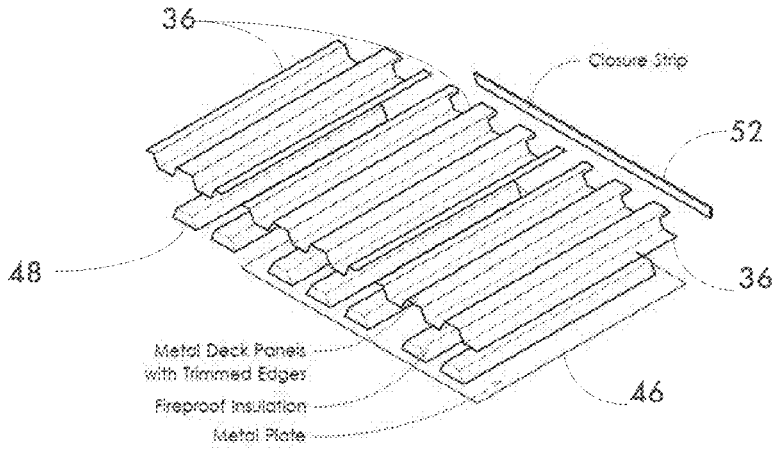

FIG. 3*e* depicts a plan view of the angled metal sheets 36 before the sheets are attached to each other. FIG. 3*f* depicts a side view of a bottom plate 46, the angled metal sheets, and pieces of fireproof insulation 48 that are shaped to fit in the channels that are formed between the bottom plate and the angled metal sheets. FIG. 3*g* depicts a perspective view of the bottom plate, the angled metal sheets, and the pieces of fireproof insulation that are shaped to fit in the channels that are formed between the bottom plate and the angled metal sheets. Portions of the fireproof insulation can also be seen in FIGS. 3*e*, 3*f*, and 3*g*. In an embodiment, the fireproof insulation may be, for example, rigid insulation sheets, foam insulation, extruded foam insulation, batt fiber insulation, mineral wool, etc. The insulation material may be installed within the channels before the angled metal sheet is attached to the bottom plate, inserted into the channels after the angled metal sheet is attached to the bottom plate, or injected into the channels. Other insulation materials and techniques for installing the insulation are possible.

Figure 3H:
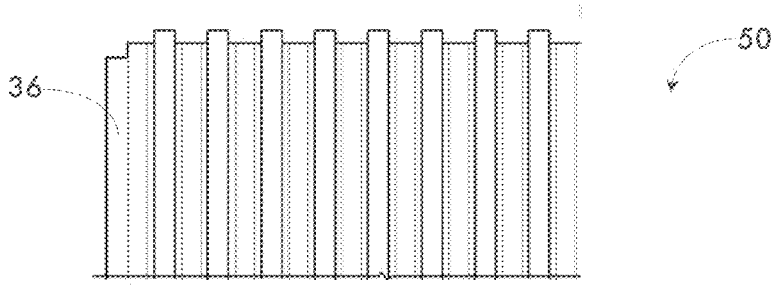
Figure 3I:
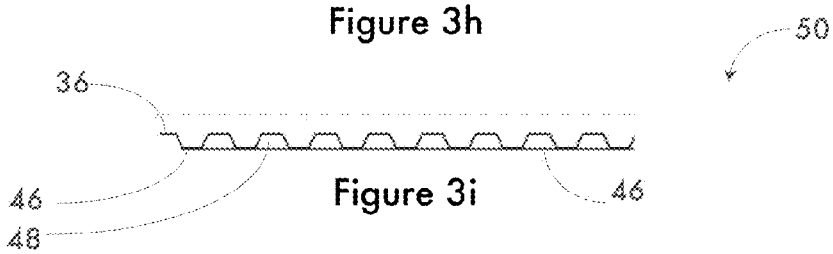
Figure 3J:
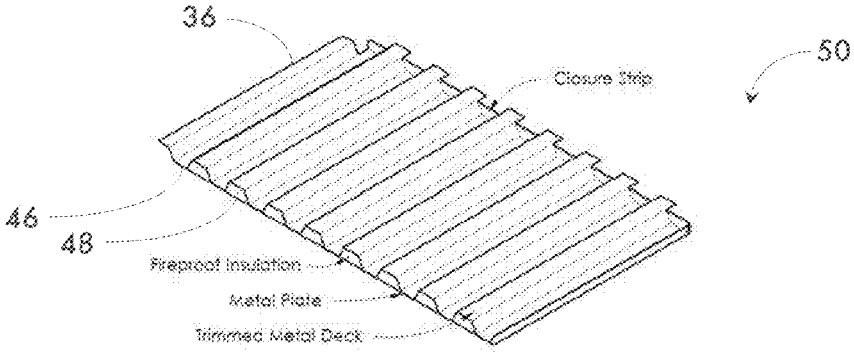

FIG. 3*h* depicts a plan view of a cellular metal deck 50 in which the angled decking sheets of FIGS. 3*b*-3*g* are connected together into a single angled metal sheet 36. FIG. 3*i* depicts a side view of the cellular metal deck including the bottom plate 46, the angled decking sheet, and the fireproof insulation 48 that is located within the channels that are formed between the bottom plate and the angled metal sheet. FIG. 3*j* depicts a perspective view of the cellular metal deck of FIGS. 3*h* and 3*i*. FIGS. 3*h* and 3*j* also depict the upper left corner of the cellular metal deck being shaped or "coped" to fit around a column of a steel framed building.

In an embodiment, the sides of the angled metal sheets 36 are configured to receive a closure strip 52 (see FIG. 3*g*), which closes off the ends of the channels that are formed between the bottom plate and the angled metal sheets. The closure strip can be made of metal and attached to the angled decking sheet and the bottom plate by, for example, welding, screwing, and/or fasteners. In an embodiment, the closure strip is made of a material that is similar to or the same as the angled metal sheets.

In an embodiment, the cellular metal deck 50 includes a closure frame that is located around the perimeter of the cellular metal deck. The closure frame includes a perimeter wall that gives the cellular metal deck more structural integrity for transport and for attachment to the steel frame of a steel framed building. The closure frame may also extend above the peaks of the angled decking sheet to provide forming for the concrete that will be poured on top of the cellular metal deck. Although the closure frame may extend above the peaks of the angled decking sheet, in other embodiments, the closure frame does not extend above the peaks of the angled decking sheet. The closure frame can be made in various shapes and sizes. In an embodiment, the material utilized for the closure frame is galvanized or stainless structural steel. The material used to make the closure frame will typically come from a steel mill at various lengths and will then be joined together by traditional methods of welding, complying with ANSI/AWS D1.1/D1.1M:2010, or using a splice plate(s) and bolt(s) and nut connections.

Specific material quality requirements for the angled metal sheet 36, the closure strip 52, and the closure frame 54 can be found, for example, in the Applicable ASTM Specifications for Various Structural Shapes, Table 2, in the material qualities as described in Designing with Structural Steel, A guide for Architects, by the American Institute of Steel Construction, 2002.

Figure 4A:
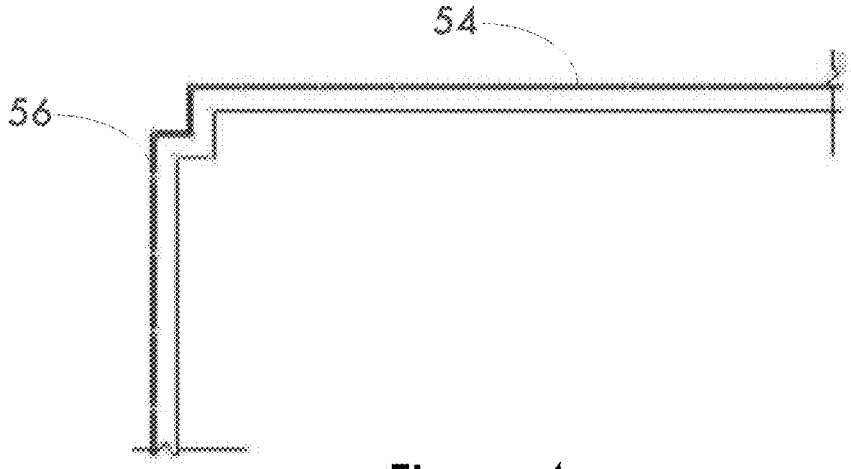
FIGS. 4*a*-4*f* depict plan, side, and perspective views of a cellular metal deck with a closure frame at the perimeter of a cellular metal deck.
Figure 4B:
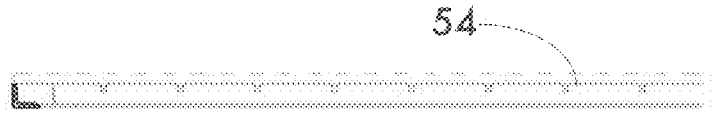
Figure 4C:
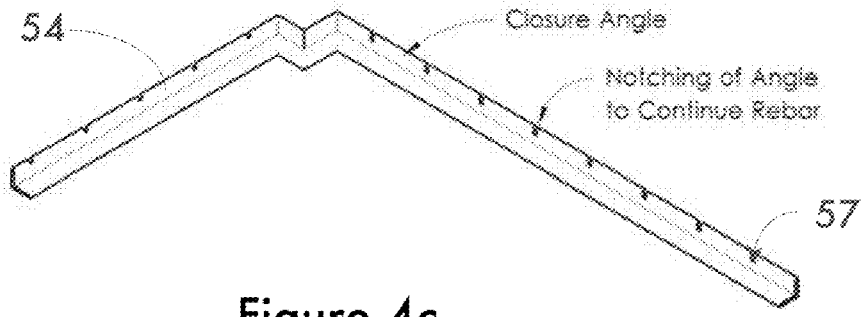

An embodiment of a closure frame 54 is described with reference to FIGS. 4*a*-4*f*. FIG. 4*a* depicts a plan view of a section of the closure frame that includes a corner 56 that is shaped to cope around a column. As illustrated in FIG. 4*a*, the closure frame has a generally right angle shape with a rectilinear coping at the right angle corner 56. In the embodiment of FIG. 4*a*, the coping is shaped to correspond to the shape of the column to which the closure frame will abut. Although an example of the shape of the closure frame is shown in FIG. 4*a*, other shapes are possible and the particular shape can be made to correspond to the geometric features of the columns of the steel frame of a steel framed building. FIG. 4*b* depicts a side view of the closure frame of FIG. 4*a* and FIG. 4*c* shows a perspective view of the closure frame of FIG. 4*a*. In the embodiment of FIGS. 4*a*-4*c*, the closure frame includes reinforcing bar receptors 57 to receive reinforcing bars. The reinforcing bar receptors are spaced apart from each other at distances that correspond to the spacing of reinforcing bars that may be part of the deck assembly module. In an embodiment, the reinforcing bar receptors are notches in the closure frame, however, in other embodiments, other types of reinforcing bar receptors are possible. Additionally, the reinforcing bar receptors may be formed to receive other types of reinforcing elements or structures.

Figure 4D:
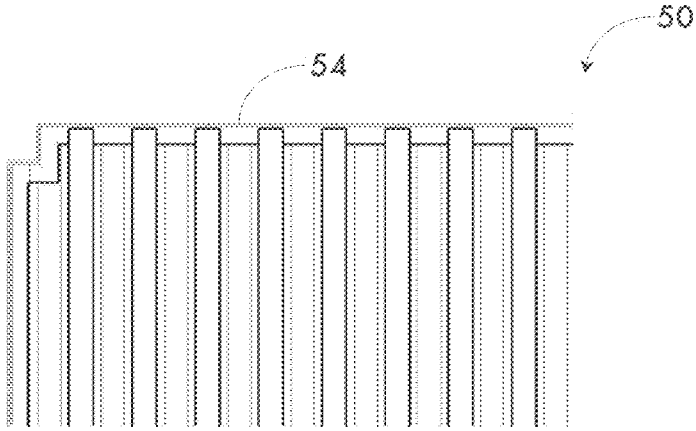
Figure 4E:
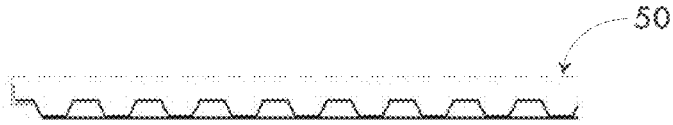
Figure 4F:
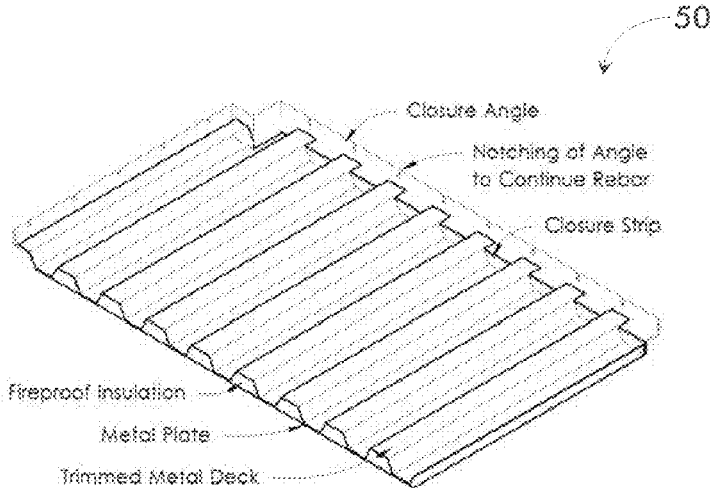

The closure frame is attached to the perimeter of the cellular metal deck 50 by, for example, welding or fastening. FIG. 4*d* depicts a plan view of the cellular metal deck that includes the closure frame 54 attached around the perimeter. FIG. 4*e* depicts a side view of the cellular metal deck of FIG. 4*d* including the closure frame. The dashed line in FIG. 4*e* indicates the location of the top surface of the concrete once the concrete is poured on top of the cellular metal deck. FIG. 4*f* depicts a perspective view of the cellular metal deck of FIGS. 4*d* and 4*e* along with the closure frame attached at the perimeter.

In an embodiment, the cellular metal deck 50 includes support elements that are located in the channels 42 formed by the troughs 38 of the angled metal sheet.

The support elements may be spaced apart from each other in a grid pattern, in which the grid pattern is predefined before the deck assembly is installed into a steel frame of a steel framed building. In an embodiment, the support elements are used to support void structures and also serve as attachment elements for attaching building system to the underside of the deck assembly module.

Figure 5A:
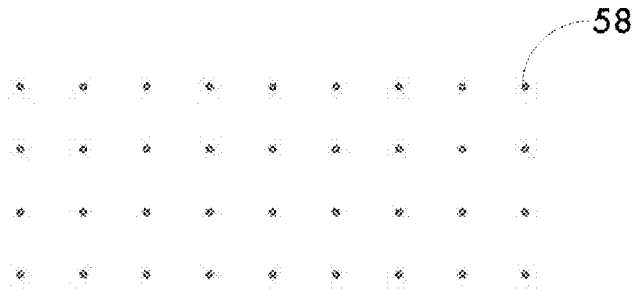
FIGS. 5*a*-5*f* depict plan, side, and perspective views of a support structures and a cellular metal deck with support structures in a grid pattern.
Figure 5B:
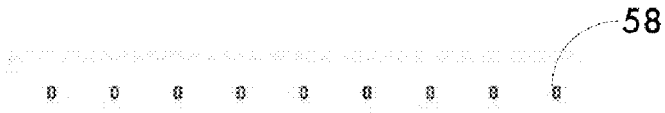
Figure 5C:
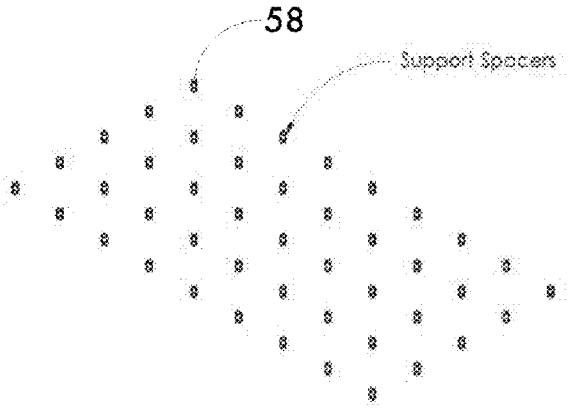

FIG. 5*a* depicts a plan view of support elements 58 spaced in a grid pattern that is applicable to the cellular metal deck 50 as described with reference to FIGS. 1-4*f*. FIG. 5*b* depicts a side view of the support elements of FIG. 5*a*. The dashed line in FIG. 5*a* indicates the location of the top surface of the concrete once the concrete is poured on top of the cellular metal deck. FIG. 5*c* depicts a perspective view of the support elements of FIGS. 5*a* and 5*b*.

Figure 5D:
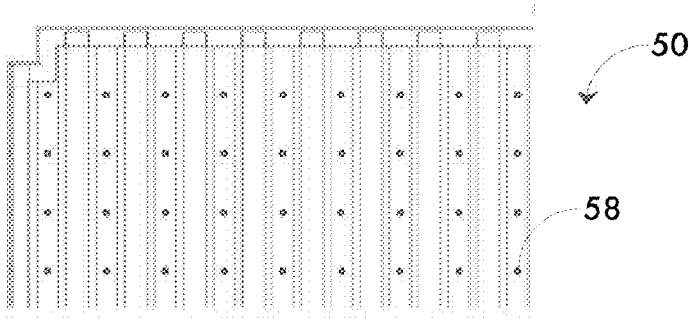
Figure 5E:
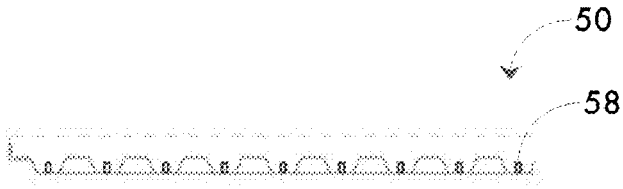
Figure 5F:
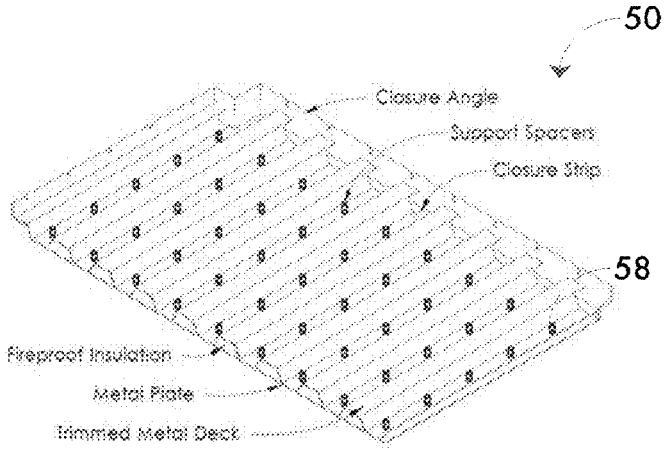

FIG. 5*d* depicts a plan view of the cellular metal deck 50 that includes the support elements 58 of FIGS. 5*a*-5*c* located in the channels 42 formed by the troughs 38 of the angled metal sheet 36 and in a predefined grid pattern having a repeating pattern of equal spacing. FIG. 5*e* depicts a side view of the cellular metal deck including the support elements of FIG. 5*d* being located in the channels formed by the troughs of the angled metal sheet. The dashed line in FIG. 5*e* indicates the location of the top surface of the concrete once the concrete is poured on top of the cellular metal deck. FIG. 5*f* depicts a perspective view of the cellular metal deck of FIGS. 5*d* and 5*e* along with the support elements in the predefined grid pattern of FIGS. 5*d* and 5*e*.

In an embodiment, the support elements 58 are internally threaded cylinders, which are accessible from the bottom major surface of the bottom plate 46 of the cellular metal deck 50 and which act dually as a support to a void structure that is connected to re-bar above and as an attachment point for building systems that are hung from the bottom side of the deck assembly module. In this embodiment, each support element is multi-functional by being both a support spacer to the void structure connected to the reinforcing bars and a threaded insert that forms the basis of an attachment feature. Traditionally, attachment features are individually installed below the deck at the required anchorage points on an as needed basis after the deck is affixed within the steel frame. For example, holes are drilled in the underside of the deck assembly and metal threaded attachment elements are hammered into the drilled holes. In accordance with an embodiment of the invention, the support elements are installed in a predefined known pattern on the cellular metal deck as part of the deck assembly process. For example, the support elements are centered in the channels formed by the troughs and spaced anywhere from one foot apart in a row to as far as two feet apart depending on the specific design requirements of the steel framed building. Because the support elements are preinstalled and accessible from the bottom major surface of the bottom plate, the deck assembly module includes an inherent attachment system that can be taken advantage of in the building design process. In an embodiment, the use of support elements as described with reference to FIGS. 5*a*-5*f* provides a known and predefined grid system for the attachment of anchorages to the underside of the deck assembly module. The locations are predefined and independent of the building systems to be attached to the deck assembly module. The patterned support elements have significant value in the lifecycle of a steel framed building since the patterned supported elements greatly reduce the need to drill into the bottom surface of the deck assembly module to create anchorage points in an occupied building.

In an embodiment, the deck assembly module 30 includes at least one void structure that creates a barrier to concrete in order to displace concrete. A void structure is used to displace a volume of concrete with a lighter material (e.g., air) to reduce the weight of the deck assembly module without compromising the structural integrity of the deck assembly module. Typical aggregate concrete has an average weight of 150 pounds per cubic foot or 125 pounds per cubic foot with lightweight aggregate. The use of the void structure can reduce the volume of concrete in the deck assembly module by at least 10% and potentially by as much as 50% of the volume of concrete based on the individual design requirements of the building's structure. In an embodiment, the void structure is made of a lightweight material such as cardboard and creates air pockets such that the volume of the void structure is filled with air instead of concrete. The void structure can be of any shape, including for example, circular, polygonal, triangular, square, pentagonal, hexagonal etc. In an embodiment, the void structure is designed to maximize the volume of the corresponding void relative to the volume of concrete while still meeting the required performance criteria of the deck assembly module. In an embodiment, the void structures are elongated circular or rectangular cardboard tubes having circular or rectangular cross-sections. Alternatively, the void structures can be made of other materials that can be configured to create voids of similar sized shapes and volumes. The use of cardboard void structures may also provide advantages that include the ability to be more ecologically sensitive by both using less concrete, which is energy intensive to make, and the use of recycled paper material for the void structures. In an embodiment, a void structure made by SONO TUBE may be used. In an embodiment, the void structures form voids of at least 2" and as large as 12". The use of a tube in a bidirectional arrangement can be achieved by cutting half of the diameter in the width of a circular void structure on one circular void structure and a corresponding mitering on another circular void structure, similar to how logs for a log cabin are mitered.

Figure 6A:
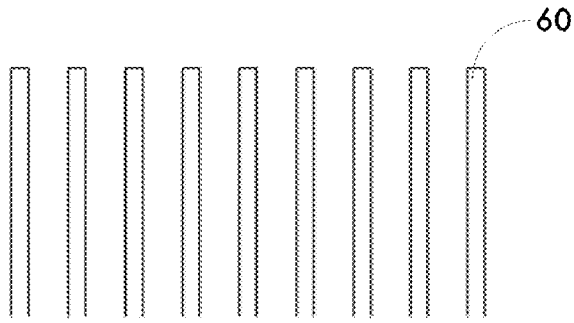
FIGS. 6*a*-6*r* depict plan, side, and perspective views of void structures and a cellular metal deck with various embodiments of void structures.
Figure 6B:
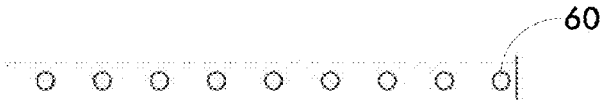
Figure 6C:
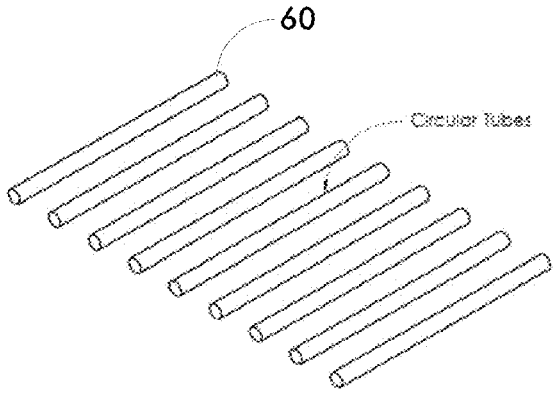

FIG. 6*a* depicts a plan view of a unidirectional layout of void structures 60, which are circular void structures laid out in a parallel pattern in spacing that corresponds to the spacing of the troughs 38 of the angled metal sheets 36 of FIGS. 3*h*-3*j*. FIG. 6*b* depicts a side view of the circular void structures of FIG. 6*a*. FIG. 6*c* depicts a perspective view of the circular void structures of FIGS. 6*a* and 6*b*.

Figure 6D:
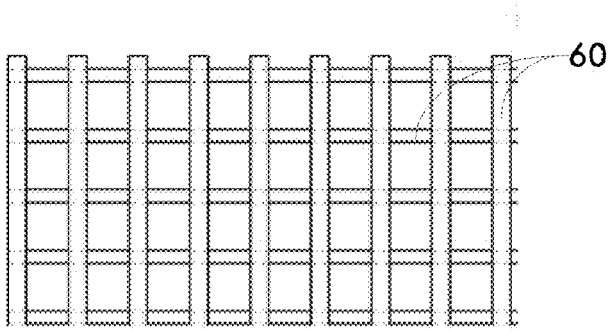
Figure 6E:
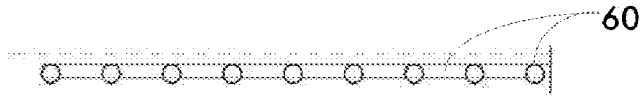
Figure 6F:
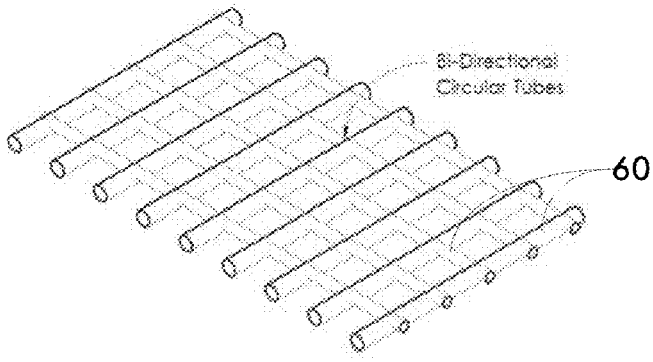

FIG. 6*d* depicts a plan view of a bidirectional layout of void structures 60, which are circular void structures laid out in a parallel grid pattern in spacing that corresponds to the spacing of the channels 42 formed by the troughs 38 of the angled metal sheet 36 of FIGS. 3*h*-3*j*. FIG. 6*e* depicts a side view of the circular void structures of FIG. 6*d*. The dashed line in FIG. 6*e* indicates the location of the top surface of the concrete once the concrete is poured on top of the cellular metal deck. FIG. 6*f* depicts a perspective view of the circular void structures of FIGS. 6*d* and 6*e*.

Figure 6G:
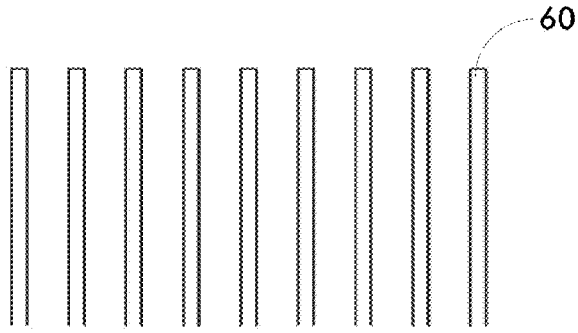
Figure 6H:
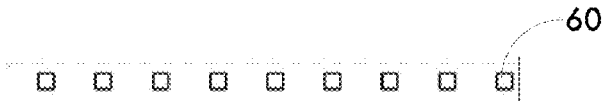
Figure 6I:
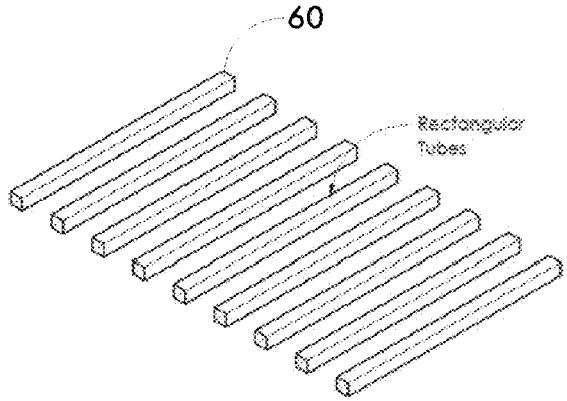

FIG. 6*g* depicts a plan view of a unidirectional layout of void structures 60, which are rectangular void structures laid out in a parallel pattern in spacing that corresponds to the spacing of the channels 42 formed by the troughs 38 of the angled metal sheet 36. FIG. 6*h* depicts a side view of the rectangular void structures of FIG. 6*g*. The dashed line in FIG. 6*g* indicates the location of the top surface of the concrete once the concrete is poured on top of the cellular metal deck. FIG. 6*i* depicts a perspective view of the rectangular void structures of FIGS. 6*g* and 6*h*.

Figure 6J:
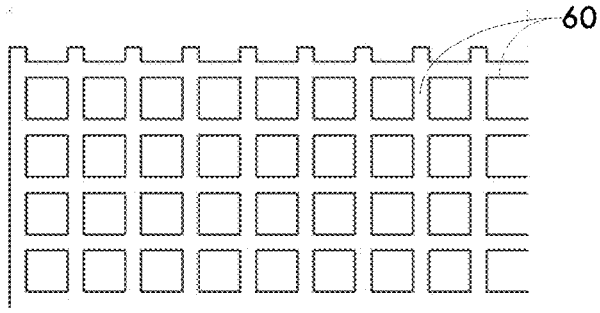
Figure 6K:
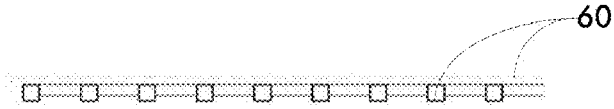
Figure 6L:
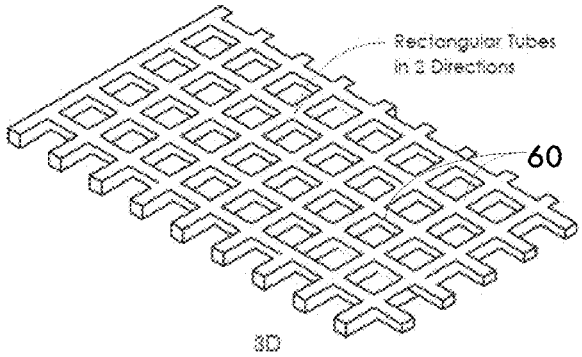

FIG. 6*j* depicts a plan view of a bidirectional layout of void structures 60, which are rectangular void structures laid out in a parallel grid pattern in spacing that corresponds to the spacing of the channels 42 formed by the troughs 38 of the angled metal sheet 36. FIG. 6*k* depicts a side view of the rectangular void structures of FIG. 6*g*. FIG. 61 depicts a perspective view of the rectangular void structures of FIGS. 6*j* and 6*k*. In an embodiment, rectangular void structures may be used to increase the volume of the void space over similarly sized circular void structures. For example, the void space of a rectangular void structure that has 1 inch square sides will be greater than a circular void structure of the same length that has a 1 inch diameter.

Figure 6M:
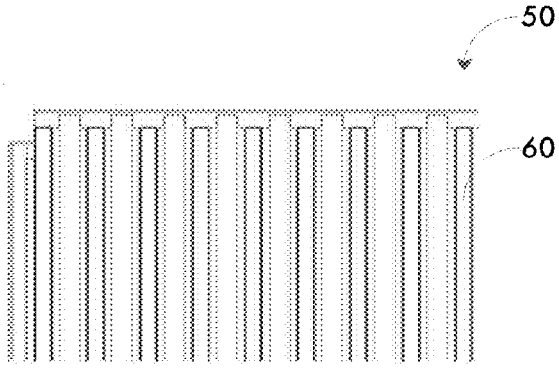
Figure 6N:
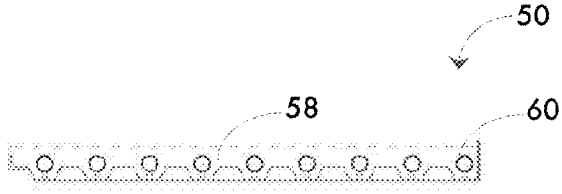
Figure 6O:
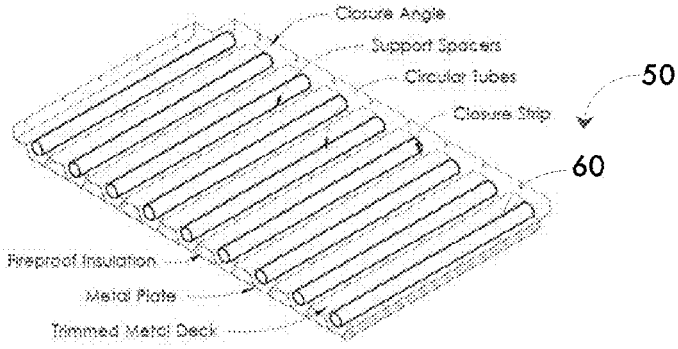

FIG. 6*m* depicts a plan view of the cellular metal deck 50 that includes a unidirectional layout of circular void structures 60 that are located in the channels formed by the troughs of the angled metal sheet 36. FIG. 6*n* depicts a side view of the cellular metal deck and the circular void structures of FIG. 6*m*. FIG. 6*n* also illustrates that the circular void structures sit on top of the support elements 58. That is, the circular void structures are in physical contact with the support elements such that the support elements set the distance between the angled metal sheet 36 and the circular void structures. The dashed line in FIG. 6*n* indicates the location of the top surface of the concrete once the concrete is poured on top of the cellular metal deck. FIG. 6*o* depicts a perspective view of the cellular metal deck and the unidirectional layout of the circular void structures of FIGS. 6*m* and 6*n*. The void structures will create void spaces of air once the concrete is poured on top of the cellular metal deck assembly.

Figure 6P:
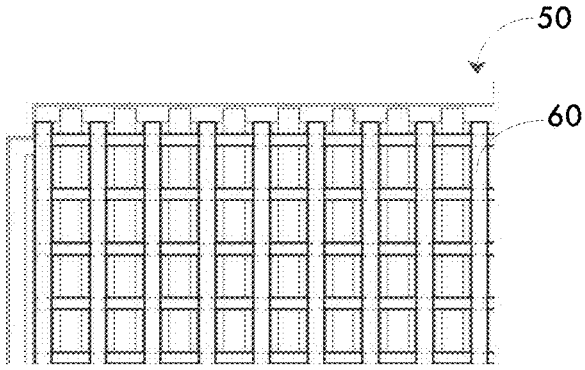
Figure 6Q:
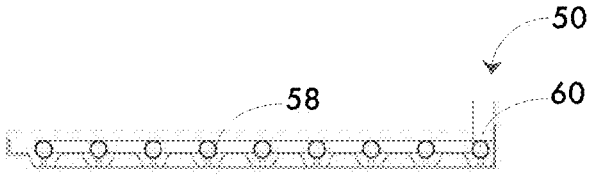
Figure 6R:
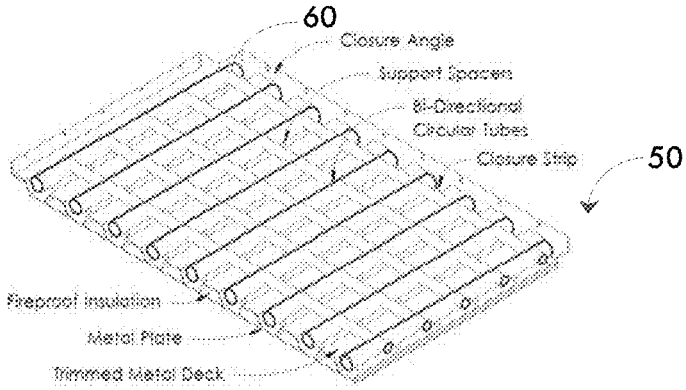

FIG. 6*p* depicts a plan view of the cellular metal deck 50 that includes a bidirectional layout of circular void structures 60 that are located in the channels 42 formed by the troughs 38 of the angled metal sheet 36. FIG. 6*q* depicts a side view of the cellular metal deck and the circular void structures of FIG. 6*p*. FIG. 6*q* also illustrates that the circular void structures sit on top of the support elements 58 and on top of the peaks of the angled metal sheet. That is, the circular void structures are in physical contact with the support elements and the angled metal sheet and the support elements set the distance between the angled metal sheet and the circular void structures. The dashed line in FIG. 6*n* indicates the location of the top surface of the concrete once the concrete is poured on top of the cellular metal deck. FIG. 6*r* depicts a perspective view of the cellular metal deck and the bidirectional layout of the circular void structures of FIGS. 6*p* and 6*q*. The void structures will create void spaces filled with air once the concrete is poured on top of the cellular metal deck assembly.

In an embodiment, the concrete of the deck assembly module is reinforced with a reinforcing structure such as reinforcing bars "rebar" or welded wire fabric. In an embodiment, the reinforcing structure is configured to comply with American Concrete Institute, ACI, specifications and other applicable building code requirements.

In an embodiment, the reinforcing structure is configured in a grid pattern. For example, the grid pattern may correspond to the channels 42 and 44 formed by the repeating pattern of troughs 38 and peaks 40 of the angled decking sheet 36. In an embodiment, the reinforcing structure is a grid pattern of rebar in which some of the rebar is parallel to the channels formed by the troughs and peaks of the angled decking sheet and some of the rebar is perpendicular to the channels formed by the troughs and peaks of the angled decking sheet. The rebar sits directly on top of the void structure shown in FIGS. 6*a*-6*r* and can be fastened to the void structure using known techniques.

Figure 7A:
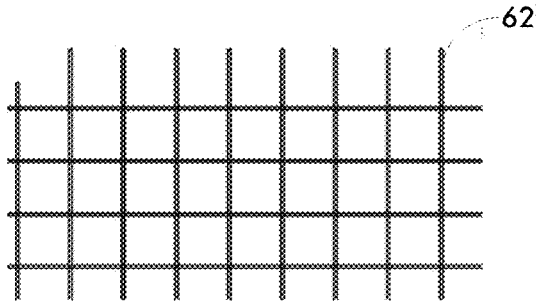
FIGS. 7*a*-7*o* depict plan, side, and perspective views of reinforcing structures and a cellular metal deck with various embodiments of reinforcing structures.
Figure 7B:
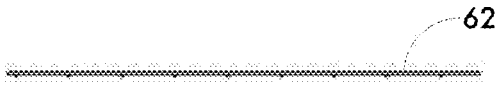
Figure 7C:
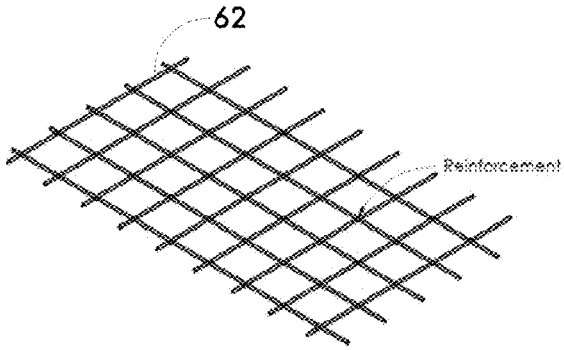

FIG. 7*a* depicts a plan view of a rebar reinforcing structure 62 in a grid pattern having spacing that corresponds to the spacing of the channels 42 formed by the troughs 38 of the angled metal sheet 36. FIG. 7*b* depicts a side view of the rebar reinforcing structure of FIG. 7*a*. FIG. 7*c* depicts a perspective view of the rebar reinforcing structure of FIGS. 7*a* and 7*b*.

Figure 7D:
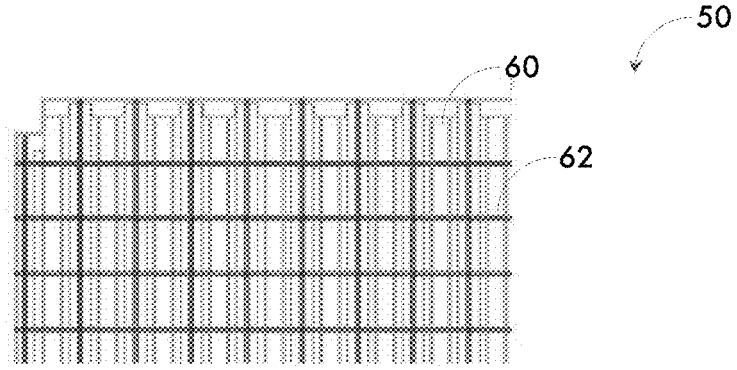
Figure 7E:
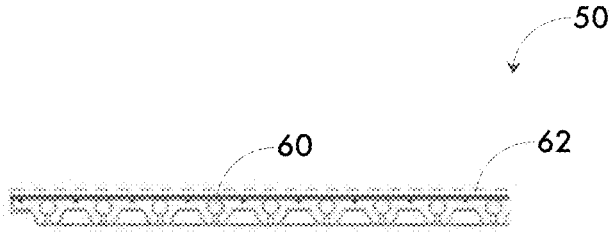
Figure 7F:
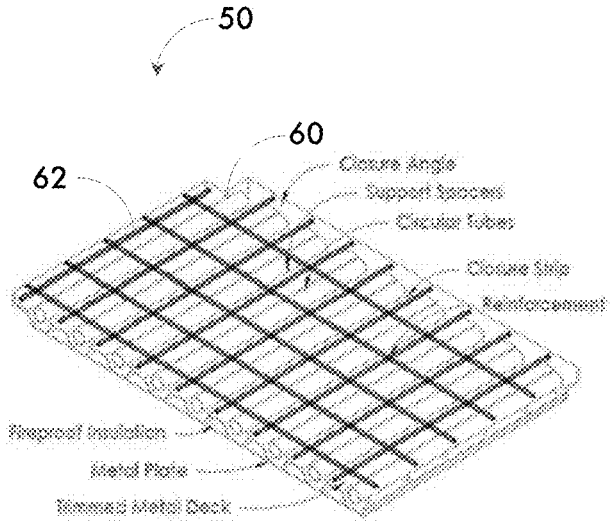

FIG. 7*d* depicts a plan view of the cellular metal deck 50 that includes the rebar reinforcing structure 62 of FIGS. 7*a*-7*c* and a void structure 60. In the embodiment of FIGS. 7*d*-7*f*, the void structure is the unidirectional and circular void structure as illustrated in FIGS. 6*a*-6*c* and 6*m*-6*o*. FIG. 7*e* depicts a side view of the cellular metal deck and the rebar reinforcing structure of FIG. 7*d*. The dashed line in FIG. 7*e* indicates the location of the top surface of the concrete once the concrete is poured on top of the cellular metal deck. FIG. 7*f* depicts a perspective view of the cellular metal deck and the rebar reinforcing structure of FIGS. 7*d* and 7*e*. As illustrated in FIGS. 7*d*-7*f*, the rebar reinforcing structure has rebar that runs parallel to and directly above the channels 44 formed by the peaks 40 of the angled metal sheet and rebar that runs perpendicular to the channels 42 formed by the troughs 38 and peaks of the angled metal sheet 36. Although an example of the reinforcing structure is described with reference to FIGS. 7*a*-7*f*, other embodiments of the reinforcing structure are possible.

Figure 7G:
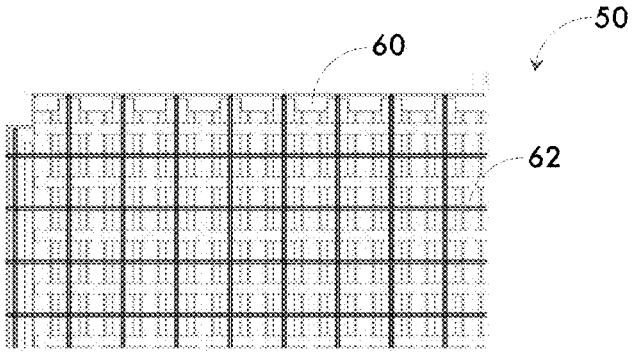
Figure 7H:
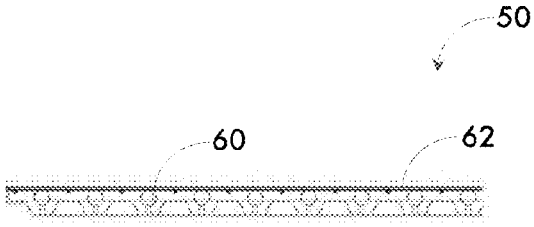
Figure 7I:
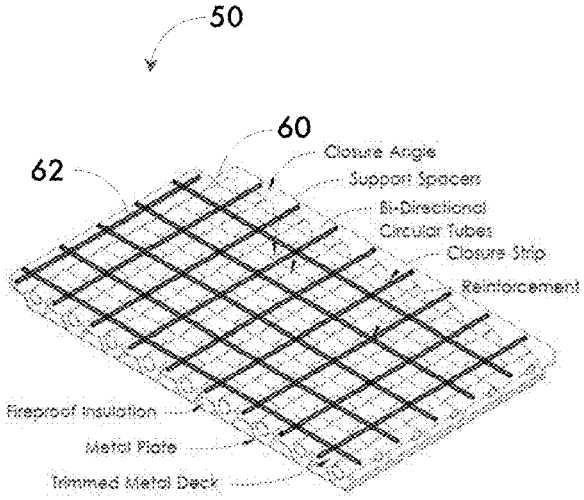

FIG. 7*g* depicts a plan view of the cellular metal deck 50 that includes the rebar reinforcing structure 62 of FIGS. 7*a*-7*c* and the bidirectional and circular void structure 60 as illustrated in FIGS. 6*d*-6*f* and 6*p*-6*r*. FIG. 7*h* depicts a side view of the cellular metal deck and the rebar reinforcing structure of FIG. 7*g*. The dashed line in FIG. 7*h* indicates the location of the top surface of the concrete once the concrete is poured on top of the cellular metal deck. FIG. 7*i* depicts a perspective view of the cellular metal deck and the rebar reinforcing structure of FIGS. 7*g* and 7*h*. As illustrated in FIGS. 7*g*-7*i*, the rebar reinforcing structure has rebar that runs parallel to and directly above the channels 44 formed by the peaks 40 of the angled metal sheet 36 and rebar that runs perpendicular to the channels 42 formed by the troughs 38 of the angled metal sheet. Additionally, the rebar runs approximately equidistant between the parallel portions of the void structure in both vertical and horizontal directions.

Figure 7J:
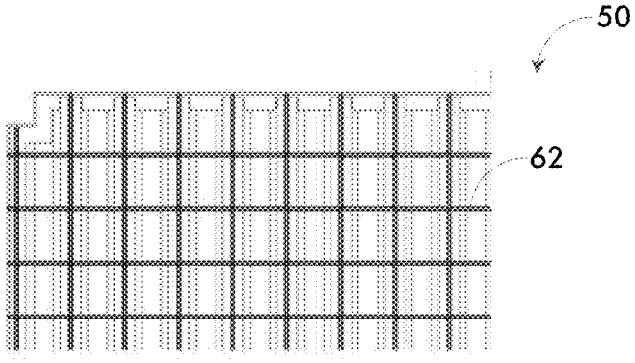
Figure 7K:
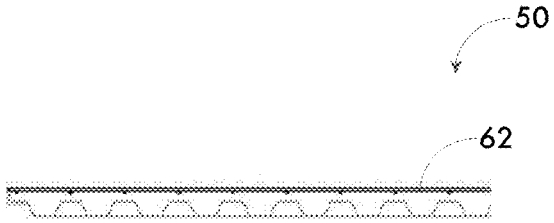
Figure 7L:
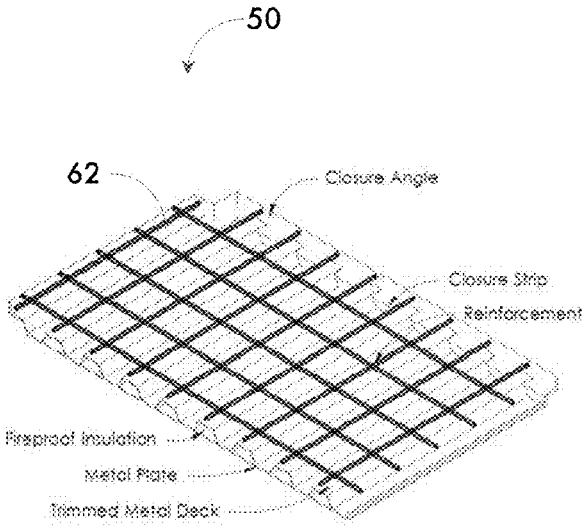

In an alternative embodiment, the deck assembly module 30 does not include a void structure. FIGS. 7*j*-7*l* depict an embodiment of the cellular metal deck 50 without a void structure and without support elements. FIG. 7*j* depicts a plan view of the cellular metal deck that includes the rebar reinforcing structure 62 of FIGS. 7*a*-7*c* without a void structure. FIG. 7*k* depicts a side view of the cellular metal deck and the rebar reinforcing structure of FIG. 7*j*. The dashed line in FIG. 7*k* indicates the location of the top surface of the concrete once the concrete is poured on top of the cellular metal deck. FIG. 71 depicts a perspective view of the cellular metal deck and the rebar reinforcing structure of FIGS. 7*j* and 7*k*. As illustrated in FIGS. 7*j*-7*l*, the rebar reinforcing structure has rebar that runs parallel to and directly above the channels formed by the peaks of the angled metal sheet and rebar that runs perpendicular to the channels formed by the troughs and peaks of the angled metal sheet.

Figure 7M:
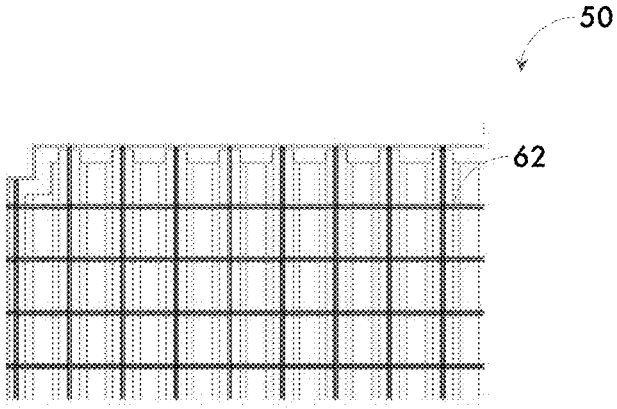
Figure 7N:
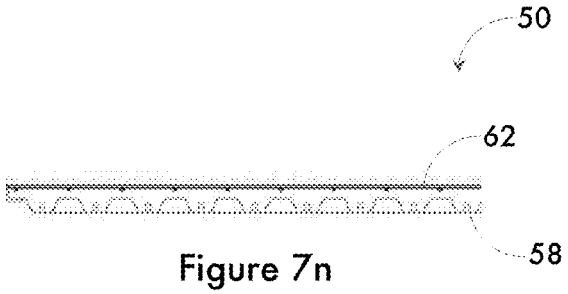
Figure 7O:
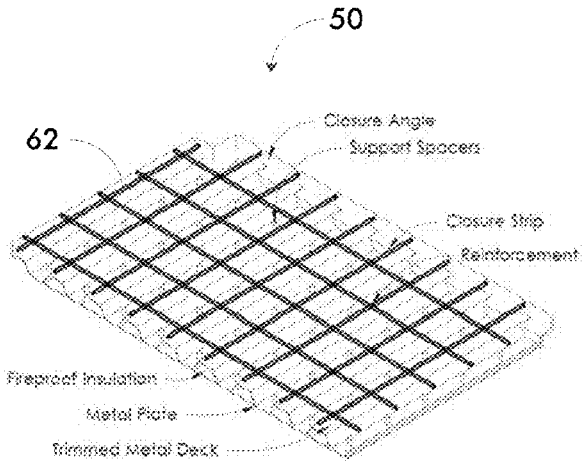

FIGS. 7*m*-7*o* depict an embodiment of the cellular metal deck 50 without a void structure but with the support elements 58. FIG. 7*m* depicts a plan view of the cellular metal deck that includes the rebar reinforcing structure 60 of FIGS. 7*a*-7*c* without a void structure. FIG. 7*n* depicts a side view of the cellular metal deck, the rebar reinforcing structure of FIG. 7*m*, and the support elements. The dashed line in FIG. 7*n* indicates the location of the top surface of the concrete once the concrete is poured on top of the cellular metal deck. FIG. 7*o* depicts a perspective view of the cellular metal deck and the rebar reinforcing structure of FIGS. 7*m* and 7*n* and support elements. As illustrated in FIGS. 7*m*-7*o*, the rebar reinforcing structure has rebar that runs parallel to and directly above the peaks of the angled metal sheet and rebar that runs perpendicular to the troughs and peaks of the angled metal sheet.

In the embodiments of FIGS. 7*d*-7*o*, the reinforcing bars may be connected to the reinforcing bar receptors 57 of the closure frame. For example, the reinforcing par receptors are notches in the closure frame 54 and the reinforcing bars sit in the notches and extend beyond the perimeter of the closure frame. Extending the reinforcing bars beyond the perimeter of the closure frame may enable adjacent deck assembly modules to be lapped together.

The cellular metal deck 50 described with reference to FIGS. 3*b*-7*o* can be assembled in a facility that is remote from the construction site of a steel framed building. In a controlled factory environment, the quality of the cellular metal deck can be tightly controlled. For example, inspections of the final cellular metal deck can be made more thoroughly and easily than in the field.

Once the cellular metal deck 50 is assembled, concrete is applied to produce the concrete deck 32 of the finished deck assembly module 30. The concrete can be applied to the cellular deck assembly in an offsite facility or on the construction site. If the concrete is applied in an offsite facility, the completed deck assembly module is transported to the construction site as a single piece and if the concrete is applied to the cellular metal deck at the construction site, the cellular metal deck is transported to the construction site without the concrete. Concrete is then mixed and poured onto the cellular metal deck at the construction site.

When applied at the construction site, the concrete is prepared by mixing the proper ingredients in the appropriate proportions to provide the performance needed and then the prepared concrete is poured onto the cellular metal deck as a wet mix. An advantage of applying the concrete at the construction site is a savings in transportation resources that results from transporting less weight and less volume of material. Advantages of applying the concrete in a controlled factory environment include: factory manufactured and applied concrete is often a better quality product because the concrete is mixed in a controlled environment and not exposed to environmental extremes; the concrete can be mixed with better quality control for the pour than in the field; and the pour operation does not have to account for the delivery time that may be involved in using a concrete mixing truck that mixes concrete at a concrete plant and then travels to the construction site to pour the concrete. In an alternative embodiment, a material other than concrete can be used to fill the volume of the deck assembly module.

Figure 8A:
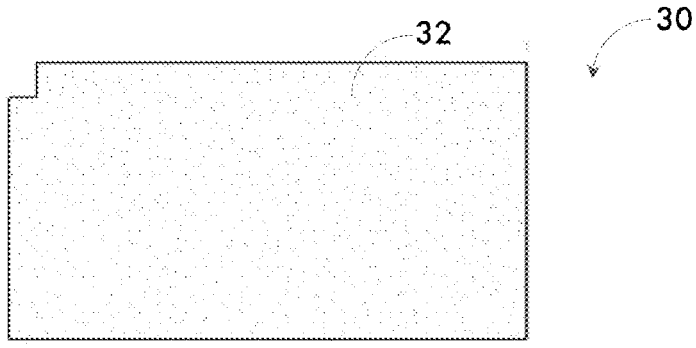
FIGS. 8*a*-8*f* depict plan, side, and perspective views of a deck assembly module that includes a cellular metal deck as described with reference to FIGS. 3*a*-7*o* and a concrete deck.
Figure 8B:
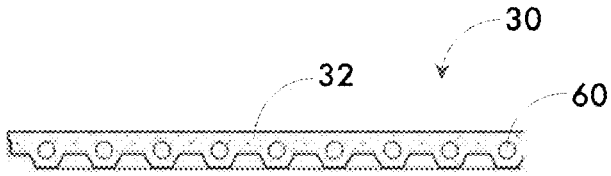
Figure 8C:
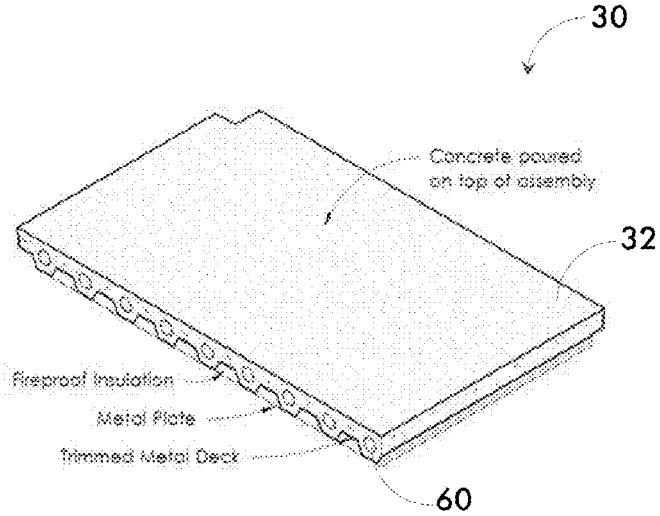

FIG. 8*a* depicts a plan view of the deck assembly module 30 after the concrete deck 32 has been added to the cellular metal deck of FIGS. 3*a*-7*o*. In the embodiment of FIGS. 8*a*-8*c*, the void structure 60 is the unidirectional and circular void structure as illustrated in FIGS. 6*a*-6*c* and 6*m*-6*o*. FIG. 8*b* depicts a side view of the deck assembly module of FIG. 8*a*. FIG. 8*c* depicts a perspective view of the deck assembly module of FIGS. 8*a* and 8*b*. As illustrated in FIGS. 8*a* and 8*c*, the upper left corner of the deck assembly module includes a polygonal feature that is shaped to correspond to the shape of a column to which the deck assembly module will abut.

Figure 8D:
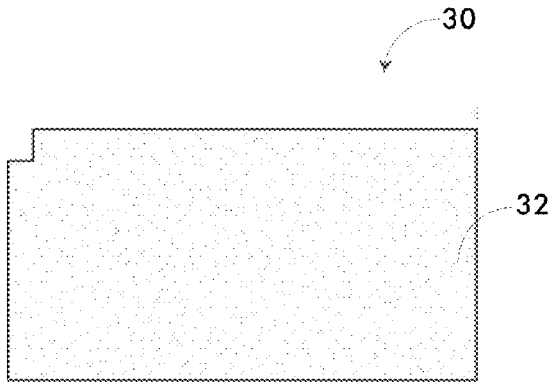
Figure 8E:
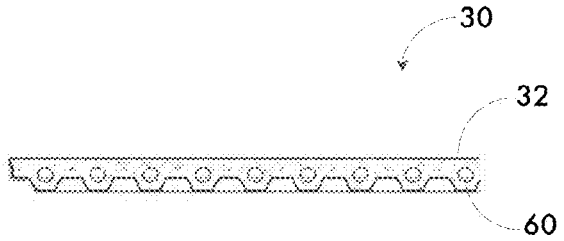
Figure 8F:
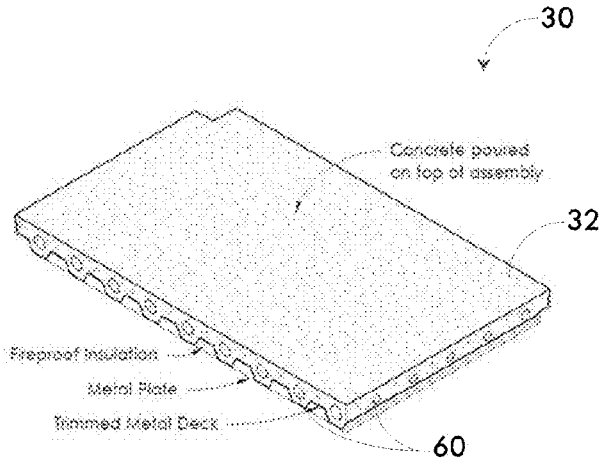

FIG. 8*d* depicts a plan view of the deck assembly module 30 after the concrete deck 32 has been added to the cellular metal deck 50 of FIGS. 3*a*-7*o*. In the embodiment of FIGS. 8*d*-8*f*, the void structure 60 is the bidirectional and circular void structure as illustrated in FIGS. 6*d*-6*f* and 6*p*-6*r*. FIG. 8*e* depicts a side view of the deck assembly module of FIG. 8*d*. FIG. 8*f* depicts a perspective view of the deck assembly module of FIGS. 8*d* and 8*e*. As illustrated in FIGS. 8*d* and 8*f*, the upper left corner of the deck assembly module includes a polygonal feature that is shaped to correspond to the shape of a column to which the deck assembly module will abut. Additionally, FIGS. 8*a*-8*c* depict the concrete deck, i.e., the top surface of the concrete.

In an embodiment, the deck assembly module 30 includes attachment elements that are accessible from the top major surface of the concrete. For example, the deck assembly module includes a predefined grid pattern of screw attachment inserts that are set in the concrete during or shortly after the pour or that are inserted into the concrete after the concrete has cured but before the deck assembly module has been installed into the steel frame of a steel framed building. In an embodiment, the attachment elements are spaced in a predefined grid pattern of equal intervals, where the intervals correspond to specific design requirements of the steel framed building. For example, the equal spacing intervals of the attachment elements can be from four inches to one foot. Installing attachment elements in a predefined pattern can facilitate independent design requirements to assemble components of a newly constructed steel framed building. Additionally, the attachment elements can be utilized to adapt the building to changes during the building's lifecycle. In an embodiment, the attachment elements are solid tapered and internally threaded cylinders, to which building system such as walls can be attached. In alternative embodiments, other attachment elements may be used.

Figure 9A:
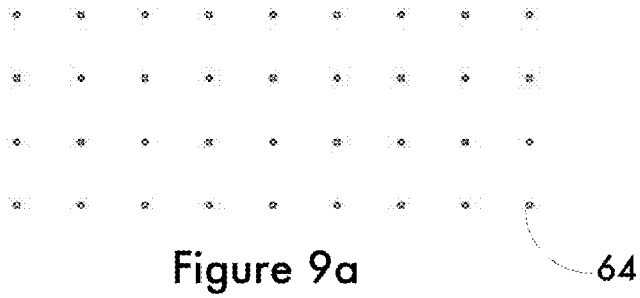
FIGS. 9*a*-9*i* depict plan, side, and perspective views of attachment elements and a deck assembly module that includes attachment elements in a grid pattern at the surface of the concrete deck.
Figure 9B:
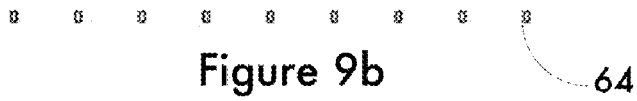

FIG. 9*a* depicts a plan view of the attachment elements 64 spaced in a grid pattern that is applicable to the plan views of the cellular metal deck 50 and the deck assembly module 30 as described above. FIG. 9*b* depicts a side view of the attachment elements of FIG. 9*a* and FIG. 9*c* depicts a perspective view of the attachment elements of FIGS. 9*a* and 9*b*.

Figure 9C:
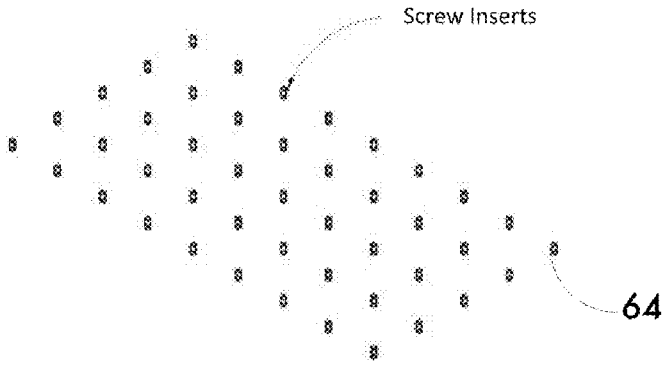
Figure 9D:
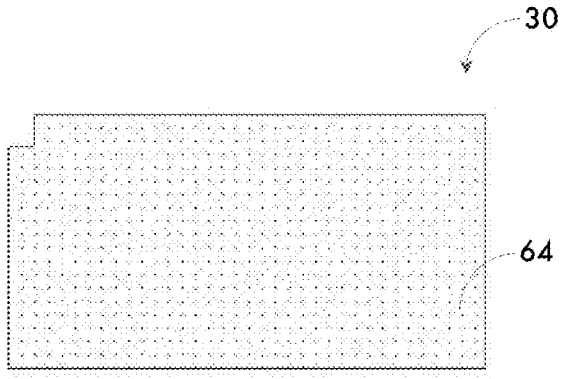
Figure 9E:
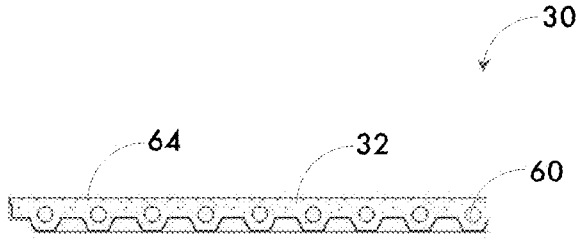
Figure 9F:
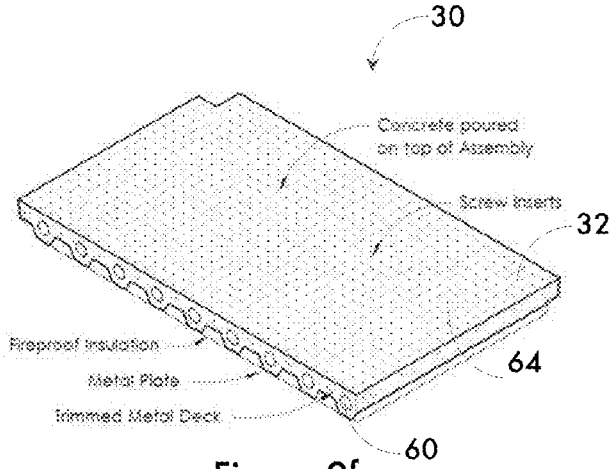

FIG. 9*d* depicts a plan view of the deck assembly module 30 that includes the attachment elements 64 distributed in the predefined grid pattern of FIGS. 9*a*-9*c* on the top major surface of the concrete deck 32. FIG. 9*e* depicts a side view of the deck assembly module including the attachment elements of FIG. 9*d*. FIG. 9*f* depicts a perspective view of the cellular metal deck of FIGS. 9*d* and 9*e* along with the attachment elements in the predefined grid pattern of FIGS. 9*d* and 9*e*.

In another embodiment, the attachment elements can be a channel track that is set within the concrete and covered with a cap that can be removed on an as needed basis. For example, a 1" unistrut embed channel can be embedded within the concrete in a predefined pattern, such as a grid pattern with equal spacing. The locations of the channel track can correspond to the specific design requirements of the steel frame building design criteria and can vary from, for example, four inches to one foot apart on center.

Figure 9G:
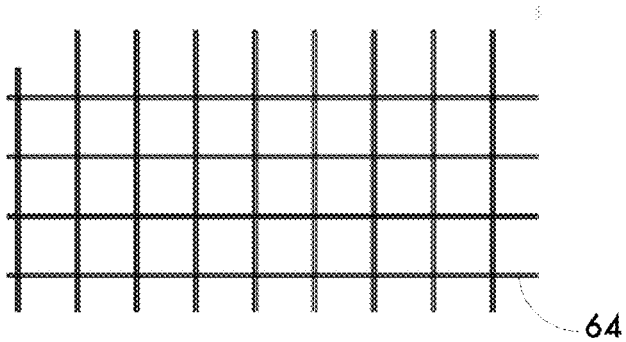
Figure 9H:
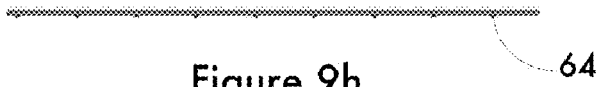
Figure 9I:
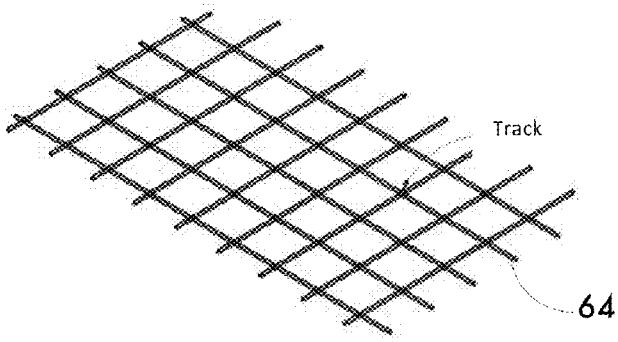

FIG. 9*g* depicts a plan view of the attachment elements 64 in the form of a unistrut embed channel spaced in a grid pattern that is applicable to the plan views of the cellular metal deck 50 and the deck assembly module 30 as described above. FIG. 9*h* depicts a side view of the attachment elements of FIG. 9*g* and FIG. 9*i* depicts a perspective view of the attachment elements of FIGS. 9*g* and 9*h*.

Once the deck assembly module 30 as described above is completed, it is inspected before being installed into the steel frame 10 of a steel framed building. For example, the deck assembly module is inspected upon arrival at the construction site to ensure that no damage has occurred to the deck assembly module during transport. The inspection can be done through conventional methods and should comply with all local, state, and federal requirements. Upon passing inspection, the deck assembly module is installed into the steel frame of a steel framed building. For example, the deck assembly module can be transferred from a delivery vehicle directly to the steel frame of a steel framed building.

The deck assembly module 30 can be placed into a bay and connected to the steel frame 10 of a steel framed building using conventional techniques. In an embodiment, the deck assembly module enables building system equipment, including but not limited to architectural, structural, mechanical, electrical, and/or plumbing components to be connected to the attachment elements on the top and bottom sides of the deck assembly module without having to drill into the deck assembly module and without having to modify the design of the deck assembly module before the deck assembly module is installed into the steel frame of the steel framed building. In an embodiment, the concrete deck 32 can be poured after the cellular metal deck 50 is installed into the steel frame of a steel framed building.

Typically, building systems are attached to the deck of a steel framed building after the deck is installed in the metal frame of a steel framed building. In an embodiment, building systems are attached to the deck assembly module before the deck assembly module is installed into the steel frame of the steel framed building. Attaching various building systems to the deck assembly module described above before installing the deck assembly module into the steel frame of the steel framed building can significantly improve the timing of the traditional placement of such building systems.

Figure 10A:
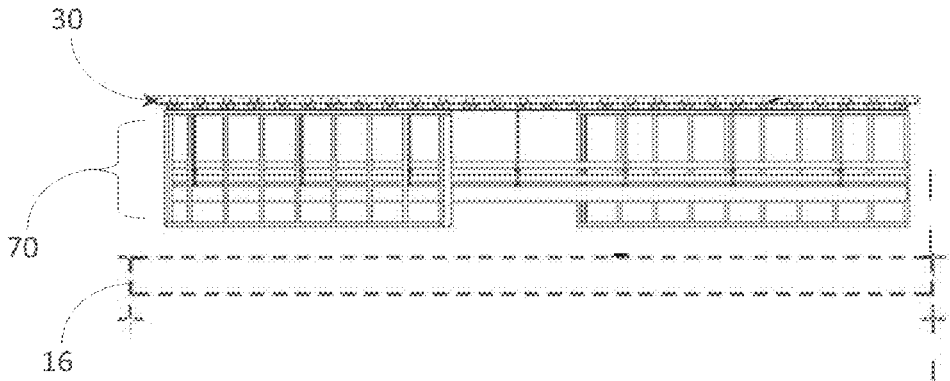
FIG. 10*a* depicts a cellular metal deck as described above with reference to FIGS. 1-9*i* that includes building systems attached at the bottom surface of the cellular metal deck.

FIG. 10*a* depicts a cellular metal deck 50 as described above with reference to FIGS. 1-9*i* that includes building systems 70, such as walls and facilities infrastructure attached at the bottom surface of the cellular metal deck. The building systems are attached to the bottom surface of the cellular metal deck using the attachment features of the support elements that were described with reference to FIGS. 5*a*-5*f*. In the embodiment of FIG. 10*a*, the cellular metal deck and attached building systems are lowered into a bay of the steel frame 10 of a steel framed building and then the cellular metal deck is attached to the steel frame. Further, in the embodiment of FIG. 10*a*, the concrete deck 32 is added to the cellular metal deck after the cellular metal deck is installed into the steel frame.

Figure 10B:
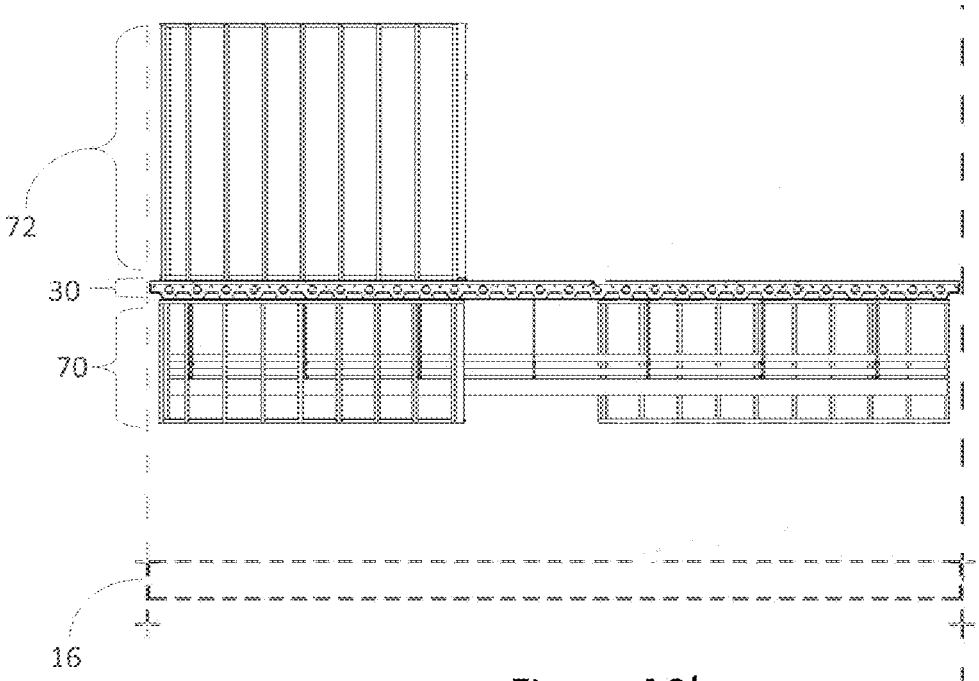
FIG. 10*b* depicts a deck assembly module that includes building systems attached at the bottom surface of the cellular metal deck and attached at the top surface of the concrete.

FIG. 10*b* depicts a deck assembly module 30 as described above with reference to FIGS. 1-9*i* that includes building systems 70 and 72, such as walls and facilities infrastructure, attached at the bottom surface of the deck assembly module and attached at the top surface of the deck assembly module. In an embodiment, the building systems are attached to the bottom surface of the cellular metal deck 30 using the attachment features of the support elements 58 that were described with reference to FIGS. 5*a*-5*f* and are attached to the top surface of the concrete using the attachment elements 64 that were described with reference to FIGS. 9*a*-9*i*. In the embodiment of FIG. 10*b*, the cellular metal deck and attached building systems are lowered into a bay of the steel frame 10 and then attached to the steel frame. In the embodiment of FIG. 10*b*, the concrete deck 32 is added to the cellular metal deck before the deck assembly module is installed into the steel frame.

Figure 10C:
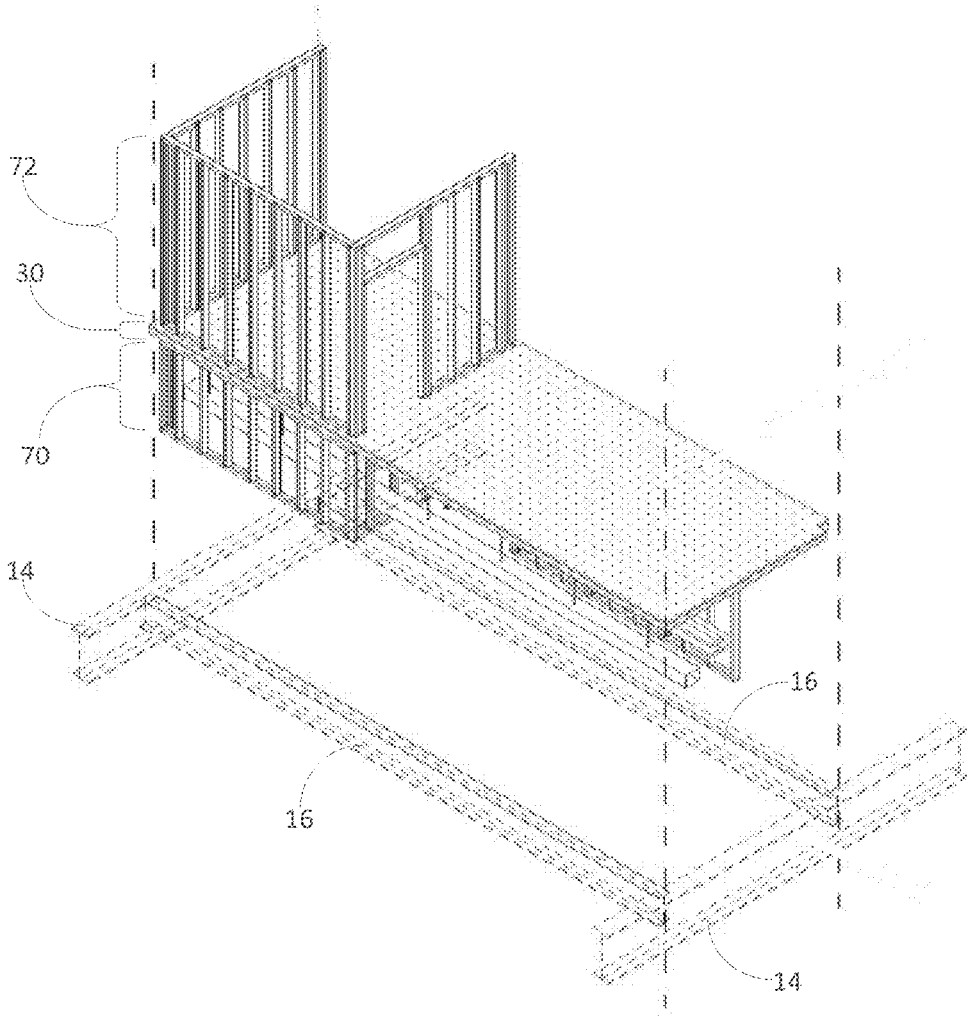
FIG. 10*c* depicts a perspective view of a deck assembly module that includes building systems attached at the bottom surface of the cellular metal deck and attached at the top surface of the concrete.

FIG. 10*c* depicts a perspective view of a deck assembly module 30 as described above with reference to FIGS. 1-9*i* that includes building systems, such as walls and facilities infrastructure, attached at the bottom surface of the cellular metal deck and attached at the top surface of the concrete deck. Building systems are attached to the bottom surface of the cellular metal deck using the attachment features of the support elements 58 that were described with reference to FIGS. 5*a*-5*f* and building systems are attached to the top surface of the concrete using the attachment elements 64 that were described with reference to FIGS. 9*a*-9*i*. In the embodiment of FIG. 10*c*, the cellular metal deck and attached building systems are lowered into a bay of the steel frame and then attached to the steel frame. In the embodiment of FIG. 10*c*, the concrete is added to the cellular metal deck before being installed in the steel frame.

Figure 11A:
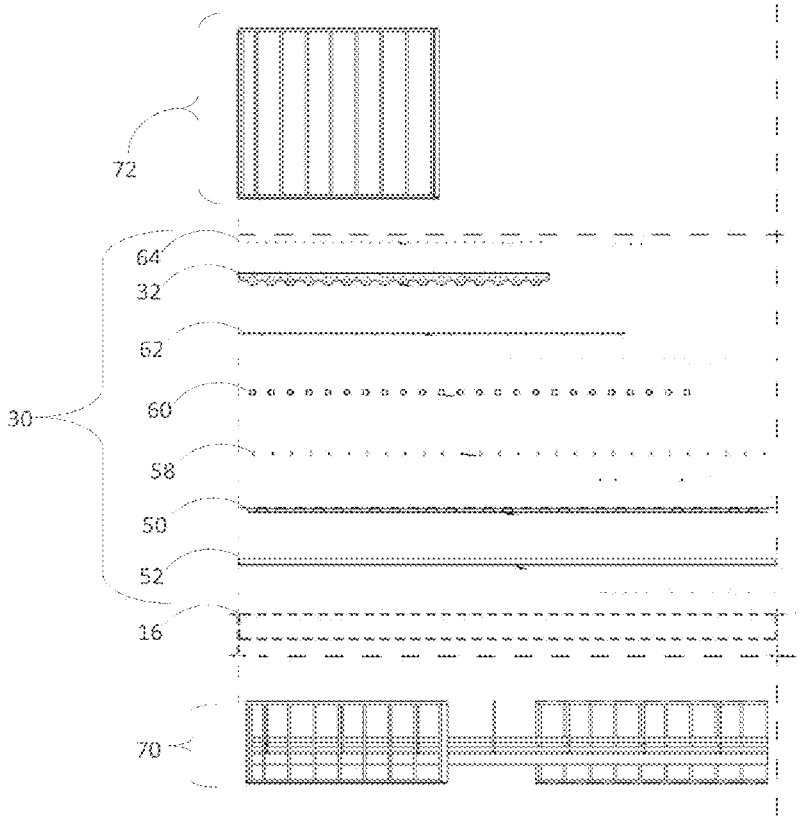
FIG. 11*a* is an expanded sectional view of a deck assembly module relative to a steel frame of a steel framed building and building systems that are attached to the top and bottom surfaces of the deck assembly module.

FIG. 11*a* is an expanded sectional view of the deck assembly module 30, relative to the steel frame (beam 16) of a steel framed building, and building systems 70 and 72 that are attached at the top and bottom surfaces of the deck assembly module. The deck assembly module is the same as or similar to the deck assembly modules described above with reference to FIGS. 1-9*i*.

Figure 11B:
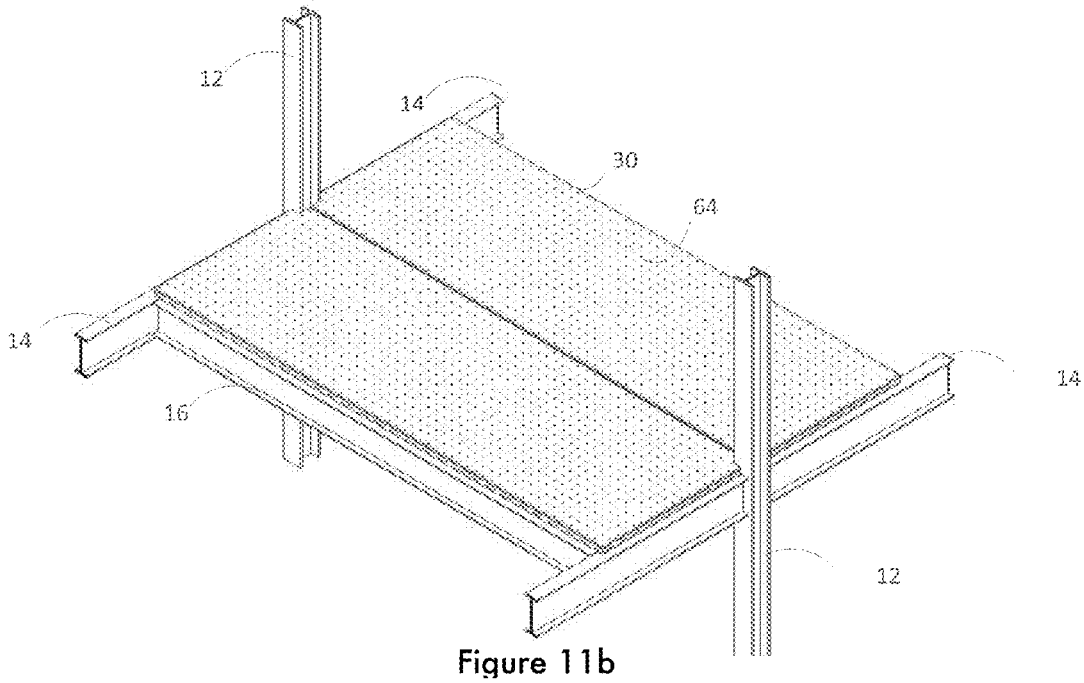
FIG. 11*b* is a perspective view of two separate deck assembly modules installed in the steel frame of a steel framed building.

FIG. 11*b* is a perspective view of two separate deck assembly modules 30 installed in the steel frame 10 (including columns 12, girders 14, and beams 16) of a steel framed building. The deck assembly modules are the same as or similar to the deck assembly modules described above in FIGS. 1-9*i*. Note that each deck assembly module has corners that are shaped or coped around the column to which the corner abuts.

Figure 11C:
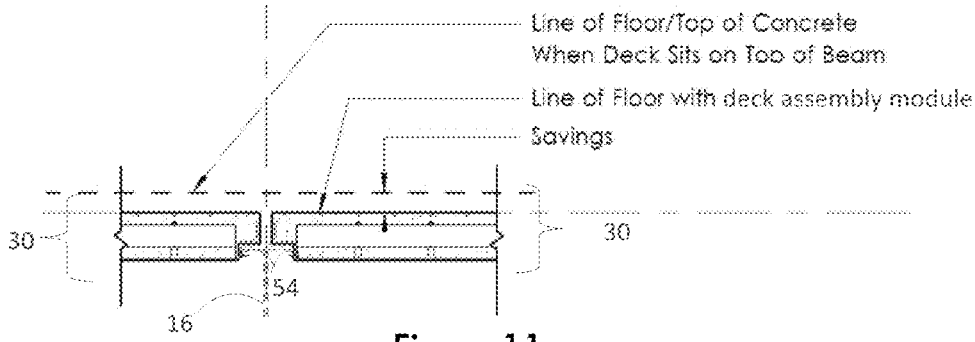
FIG. 11*c* depicts a side view of an embodiment of a deck assembly module in which the perimeter of the deck assembly module includes an angled flange.

In an embodiment, the deck assembly modules 30 are designed so that the deck assembly modules do not sit entirely above the top plane of the top flange of the beams and girders. FIG. 11*c* depicts a side view of an embodiment of the deck assembly module in which the perimeter of the deck assembly module includes an angled flange. The angled flange is shaped to correspond to the dimensions of the I-beams that make up the beams and girders of a bay of the steel frame. In an embodiment, the closure frame 54 around the perimeter of a deck assembly module is configured to include an angled flange that has a portion that will sit on top of the top flange of the I-beams. The angled flange allows a portion of the deck assembly module to sit below the top of the top flange of the I-beams. Because a portion of the deck assembly module sits below the top of the top flange of the I-beams, there is some vertical space savings between floors of a steel framed building.

Figure 11D:
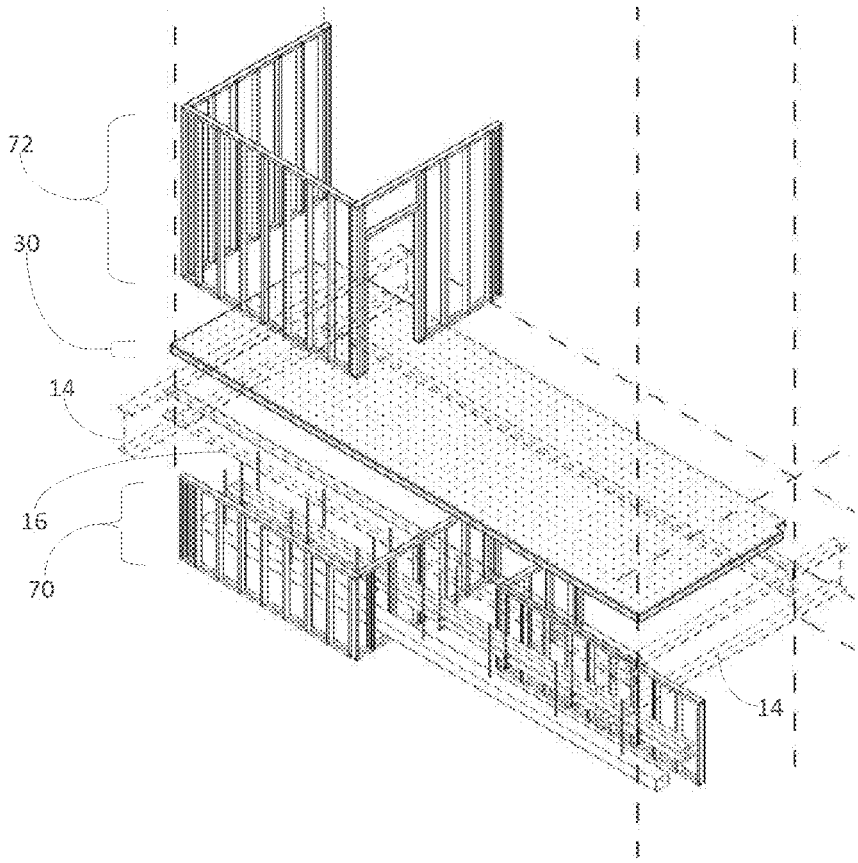
FIG. 11*d* depicts a perspective view of a deck assembly module as described above relative to the steel frame of a steel frame building.

FIG. 11*d* depicts a perspective view of a deck assembly module 30 as described above relative to the steel frame 10 (including girders 14 and beams 16) of a steel frame building. FIG. 11*d* also depicts various building systems 70 and 72 (e.g., walls and building facilities such as plumbing, electrical, and HVAC) that can be attached at the top and bottom of the deck assembly module using the above-described attachment elements.

Various embodiments of a deck assembly module 30 have been described above. The deck assembly module provides an intelligent customizable modular steel and concrete deck, which may include integrated attachment elements. The deck assembly module can be filled with concrete at the building site where building construction occurs or the deck assembly module can be filled with concrete at a remote pre-fabrication facility. Both options enable installation of building systems prior to the deck assembly module being installed into the steel frame of a steel framed building. An embodiment of the deck assembly module may provide benefits in the construction of steel framed buildings such as: a modular assembly that fits within the steel frame of a steel framed building; a reduced combined floor and beam system dimension because the deck assembly module sits at least partially below the top flange of the beams; similar or greater volume of floor design with a reduced weight through the use of void structures; and a predetermined attachment system that provides predefined connection points on the bottom and top surfaces of the deck assembly module.

In an embodiment, instances of roof construction may not require concrete or re-bar. Roofing requirements may be building specific and the above described cellular metal deck 50 can be utilized as a component for the roof level of a steel framed building, minus the flooring material (e.g., the concrete).

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

What is claimed is:

1. A deck assembly module for a steel framed building, the deck assembly module comprising:

a cellular metal deck comprising:

a bottom plate having a top major surface and a bottom major surface;

an angled decking sheet; and fireproof insulation;

wherein the angled decking sheet is angled to form a repeating pattern of troughs and peaks;

wherein the angled decking is adjacent to the top major surface of the bottom plate; and wherein the fireproof insulation is located in channels formed by the peaks of the angled decking sheet and the top surface of the bottom plate and the angled decking sheet;

further comprising:

a plurality of support elements located in the troughs of the angled decking sheet, wherein the support elements are spaced apart from each other in a grid pattern that is pre-defined before the deck assembly is installed into the steel framed building and wherein the bottom plate has through holes that correspond to the locations of the plurality of support elements such that the plurality of support elements are accessible from the bottom major surface of the bottom plate;

a concrete deck formed on top of the angled decking sheet, the concrete deck having a top major surface that is opposite the angled decking sheet; and top deck attachment elements affixed within the concrete deck and accessible at the top major surface of the concrete deck, wherein the top deck attachment elements are spaced apart from each other in a grid pattern and wherein the grid pattern is predefined before the deck assembly module is installed into the steel framed building.

2. The deck assembly module of claim 1, further comprising a closure strip that is perpendicular to the repeating pattern of troughs and peaks and encloses the fireproof insulation at a perimeter of the cellular metal deck between the bottom plate and the angled decking sheet.

3. The deck assembly module of claim 1, further comprising a closure frame around the perimeter of the cellular metal deck, the closure frame comprising a perimeter wall that extends above the peaks of the angled decking sheet.

4. The deck assembly module of claim 3, wherein the closure frame includes reinforcing bar receptors spaced at distances that correspond to spacing of re-enforcing bars.

5. The deck assembly module of claim 1, further comprising a plurality of support elements located in the troughs of the angled decking sheet.

6. The deck assembly module of claim 5, wherein the support elements are spaced apart from each other in a grid pattern.

7. The deck assembly module of claim 6, wherein the grid pattern is pre-defined before the deck assembly is installed into the steel framed building.

8. The deck assembly module of claim 5, wherein the bottom plate has through holes that correspond to the locations of the plurality of support elements such that the plurality of support elements are accessible from the bottom major surface of the bottom plate.

9. The deck assembly module of claim 8, wherein the plurality of support elements include attachment features for attaching additional building system elements to the deck assembly at the bottom surface of the bottom plate.

10. The deck assembly module of claim 9, wherein the support elements are internally threaded.

11. The deck assembly module of claim 5, further comprising at least one void structure configured to create a barrier to concrete.

12. The deck assembly module of claim 11, wherein the void structure sits directly on the support elements in the troughs of the angled decking sheet.

13. The deck assembly module of claim 11, wherein the void structure comprises tubes that are located in the troughs of the cellular metal deck.

14. The deck assembly module of claim 11, wherein the void structure comprises tubes that are located on top of the support elements in the troughs of the cellular metal deck.

15. The deck assembly module of claim 11, wherein the void structure includes elongated void structures that are arranged unidirectionally in a direction that is parallel to the channels formed by the troughs and peaks.

16. The deck assembly module of claim 11, wherein the void structure includes elongated void structures that are arranged bidirectionally in a grid pattern that is parallel to and perpendicular to the channels formed by the troughs and peaks.

17. The deck assembly module of claim 1, further comprising a reinforcing structure located above the cellular metal deck.

18. The deck assembly module of claim 1, further comprising reinforcing bars in a grid pattern wherein the spacing of the grid pattern matches the spacing of the channels formed by the troughs and peaks of the angled decking sheet.

19. The deck assembly module of claim 1, further comprising:

a closure frame around the perimeter of the cellular metal deck, the closure frame comprising a perimeter wall that extends vertically above the peaks of the angled decking sheet; and a grid pattern of reinforcing bars;

wherein the closure frame includes reinforcing bar receptors spaced at distances that correspond to spacing of reinforcing bars and wherein at least some of the reinforcing bars are engaged with the reinforcing bar receptors.

20. The deck assembly module of claim 1, further comprising a concrete deck formed on top of the angled decking sheet.

21. The deck assembly module of claim 1, further comprising at least one void structure and a concrete deck formed on top of the angled decking sheet and encapsulating the at least one void structure.

22. The deck assembly module of claim 1, further comprising a concrete deck formed on top of the angled decking sheet, the concrete deck having a top major surface that is opposite the angled decking sheet, and top deck attachment elements affixed within the concrete deck and accessible at the top major surface.

23. The deck assembly module of claim 22, wherein the top deck attachment elements are spaced apart from each other in a grid pattern.

24. The deck assembly module of claim 23, wherein the grid pattern is predefined before the deck assembly module is installed into the steel framed building.

25. The deck assembly module of claim 1, wherein the cellular metal deck has a perimeter shape that corresponds to dimensions of a bay of the steel frame building.

26. The deck assembly module of claim 1, wherein the cellular metal deck has a perimeter shape that corresponds to a location in the steel frame building that includes a vertical support column and wherein the perimeter shape copes at least partially around the vertical support column.

27. The deck assembly module of claim 1, wherein the cellular metal deck has a perimeter shape that corresponds to a location in the steel frame building that does not include a vertical support column and wherein the perimeter shape is rectangular.

28. A deck assembly module for a steel framed building, the deck assembly module comprising:

a cellular metal deck comprising:

a bottom plate having a top major surface and a bottom major surface;

an angled decking sheet;

fireproof insulation;

wherein the angled decking sheet is angled to form a repeating pattern of troughs and peaks;

wherein the angled decking is adjacent to the top major surface of the bottom plate; and wherein the fireproof insulation is located in channels formed by the peaks of the angled decking sheet and the top surface of the bottom plate and the angled decking sheet;

the cellular metal deck further comprising:

a plurality of support elements located in the channels formed by the troughs of the angled decking sheet and spaced apart in a grid pattern;

at least one void structure configured to create a barrier to concrete, wherein the void structure sits directly on the support elements in channels formed by the troughs of the angled decking sheet and wherein the void structure is supported by the support elements;

a reinforcing structure above the void structure;

a closure frame around the perimeter of the cellular metal deck, the closure frame comprising a perimeter wall that extends above the peaks of the angled decking sheet; and a concrete deck formed on top of the angled decking sheet and at least partially bordered by the closure frame;

wherein the bottom plate has through holes that correspond to the locations of the plurality of support elements such that the plurality of support elements are accessible from the bottom major surface of the bottom plate;

wherein the plurality of support elements include attachment features for attaching additional building system elements to the deck assembly at the bottom surface of the bottom plate.

29. The deck assembly module of claim 28, wherein the grid pattern that is pre-defined before the deck assembly is installed into the steel framed building and wherein the bottom plate has through holes that correspond to the locations of the plurality of support elements such that the plurality of support elements are accessible from the bottom major surface of the bottom plate;

the concrete deck having a top major surface that is opposite the angled decking sheet; and top deck attachment elements affixed within the concrete deck and accessible at the top major surface of the concrete deck, wherein the top deck attachment elements are spaced apart from each other in a grid pattern and wherein the grid pattern is predefined before the deck assembly module is installed into the steel framed building.

30. The deck assembly module of claim 28, wherein the support elements are internally threaded.

31. The deck assembly module of claim 28, wherein the concrete deck has a top major surface that is opposite the angled decking sheet, and top deck attachment elements affixed within the concrete and accessible at the top major surface.

32. The deck assembly module of claim 31, wherein the top deck attachment elements are spaced apart from each other in a grid pattern that is predefined before the deck assembly module is installed into the steel framed building.

33. A deck assembly module for a steel framed building, the deck assembly module comprising:

a cellular metal deck;

a plurality of support elements located in the cellular metal deck, wherein the support elements are spaced apart from each other in a grid pattern that is pre-defined before the deck assembly is installed into the steel framed building and wherein the support elements include attachment features that are accessible from a bottom major surface of the cellular metal deck;

a concrete deck formed on top of the cellular metal deck, the concrete deck having a top major surface that is opposite the cellular metal deck; and top deck attachment elements affixed within the concrete deck and accessible at the top major surface of the concrete, wherein the top deck attachment elements are spaced apart from each other in a grid pattern and wherein the grid pattern is predefined before the deck assembly module is installed into the steel framed building;

wherein the cellular metal deck comprises;

a bottom plate having a top major surface and a bottom major surface;

an angled decking sheet; and fireproof insulation;

wherein the angled decking sheet is angled to form a repeating pattern of troughs and peaks;

wherein the angled decking is adjacent to the top major surface of the bottom plate; and wherein the fireproof insulation is located in channels formed by the peaks of the angled decking sheet and the top surface of the bottom plate and the angled decking sheet.

34. A deck assembly module for a steel framed building, the deck assembly module comprising:

a cellular metal deck comprising:

a bottom plate having a top major surface and a bottom major surface;

an angled decking sheet;

fireproof insulation;

wherein the angled decking sheet is angled to form a repeating pattern of troughs and peaks;

wherein the angled decking is adjacent to the top major surface of the bottom plate; and wherein the fireproof insulation is located in channels formed by the peaks of the angled decking sheet and the top surface of the bottom plate and the angled decking sheet;

the cellular metal deck further comprising:

a plurality of support elements located in the channels formed by the troughs of the angled decking sheet and spaced apart in a grid pattern;

at least one void structure configured to create a barrier to concrete, wherein the void structure sits directly on the support elements in channels formed by the troughs of the angled decking sheet and wherein the void structure is supported by the support elements;

a reinforcing structure above the void structure;

a closure frame around the perimeter of the cellular metal deck, the closure frame comprising a perimeter wall that extends above the peaks of the angled decking sheet; and a concrete deck formed on top of the angled decking sheet and at least partially bordered by the closure frame, wherein the concrete deck has a top major surface that is opposite the angled decking sheet, and top deck attachment elements affixed within the concrete and accessible at the top major surface.

35. The deck assembly module of claim 34, wherein the top deck attachment elements are spaced apart from each other in a grid pattern that is predefined before the deck assembly module is installed into the steel framed building.

* * * * *